US009308534B2

(12) United States Patent
Lee

(10) Patent No.: US 9,308,534 B2
(45) Date of Patent: Apr. 12, 2016

(54) JET MILL COMBINING HIGH SPEED GRINDING APPARATUS AND HIGH SPEED GRINDING APPARATUS WITH JET MILL MOUNTED THEREON

(71) Applicant: JM TECH CO., LTD., Kimpo-si, Gyeonggi-do (KR)

(72) Inventor: Kyung-bok Lee, Incheon (KR)

(73) Assignee: JM Tech Co., Ltd. (KR)

( * ) Notice: Subject to any disclaimer, the term of this patent is extended or adjusted under 35 U.S.C. 154(b) by 115 days.

(21) Appl. No.: 14/314,255

(22) Filed: Jun. 25, 2014

(65) Prior Publication Data

US 2015/0069156 A1 Mar. 12, 2015

(30) Foreign Application Priority Data

Sep. 12, 2013 (KR) ..... 10-2013-0110040

(51) Int. Cl.
*B02C 19/00* (2006.01)
*B02C 19/06* (2006.01)

(52) U.S. Cl.
CPC ..... *B02C 19/063* (2013.01)

(58) Field of Classification Search
CPC .... B02C 19/06; B02C 19/061; B02C 19/063; B02C 19/065
USPC ..... 241/39, 5, 261.1, 242, 260, 60, 243, 241/101.2
See application file for complete search history.

(56) References Cited

U.S. PATENT DOCUMENTS 1,614,486 A * 1/1927 Murphy ..... D21D 1/18 241/242
1,885,283 A * 11/1932 Ostermann ..... B02C 2/10 241/245
5,383,616 A * 1/1995 Svaighert ..... A61F 13/15626 241/242
6,415,999 B1 * 7/2002 Nied ..... B02C 18/148 241/242
8,888,027 B2 * 11/2014 Trembley ..... B02C 13/14 241/261.1

* cited by examiner

*Primary Examiner* — Faye Francis
(74) *Attorney, Agent, or Firm* — Park & Associates IP Law, P.C.

(57) ABSTRACT

The present invention relates to a jet mill combining a high speed grinding apparatus and a high speed grinding apparatus with a jet mill mounted thereon wherein in consideration of the properties of aluminum having a high degree of softness, pressurizing air is injected not through existing air nozzles, but through injection holes, and the number of injection holes and the approach angles toward air of the injection holes are optimized to maximize the particle collision of the grinding object, thereby manufacturing granules having particle sizes in the range between 100 μm and 1000 μm.

18 Claims, 17 Drawing Sheets

JET MILL COMBINING HIGH SPEED GRINDING APPARATUS AND HIGH SPEED GRINDING APPARATUS WITH JET MILL MOUNTED THEREON

REFERENCE TO RELATED APPLICATIONS

This application claims the priority benefit of Korean Patent Application No. 10-2013-0110040 filed on Sep. 12, 2013, the entire contents of which are incorporated herein by reference.

FIELD OF THE INVENTION

The present invention relates to a jet mill combining a high speed grinding apparatus and a high speed grinding apparatus with a jet mill mounted thereon, and more particularly, to a jet mill combining a high speed grinding apparatus and a high speed grinding apparatus with a jet mill mounted thereon wherein in consideration of the properties of aluminum having a high degree of softness, pressurizing air is injected not through existing air nozzles, but through injection holes, and the number of injection holes and the approach angles toward air of the injection holes are optimized to maximize the particle collision of the grinded object, thereby manufacturing granules having particle sizes in the range between 100 μm and 1000 μm.

BACKGROUND OF THE INVENTION

Aluminum is a high value-added rare metal having excellent conductivity, corrosion resistance, and workability, and thus, it is used as alloy or a secondary material of special steel through the combination with various elements. As a result, there is a high demand for aluminum as a raw material.

In view of the fact that 97% of the total amount of resources consumed in Korea is dependent upon imports, especially, importing the aluminum raw material causes enormous financial damages, and therefore, aluminum recycling industry has been the center of interest, so that the waste aluminum raw material is grinded to fine particles and thus recycled to aluminum granules having high purity.

One of grinding apparatuses is disclosed in Korean Patent Application No. 10-2013-0110039 (entitled: aluminum granule recycling process) filed by the same applicant as the invention, wherein a high speed grinding apparatus adequate to aluminum grinding includes rotary blades located in multiple stages, a fixed blade part located outside the rotary blades and having vortex flow grooves formed to generate vortex flows therefrom, and an impeller adapted to increase the discharge pressure of air, thereby activating the particle collision through the rotation of the rotary blades and the vortex flows generated by the vortex flow grooves of the fixed blade part thus to manufacture the granules having particle sizes in the range between 100 μm and 1000 μm.

The high speed grinding apparatus as mentioned above performs the particle collision of the grinded object just through the rotation of the rotary blades and the vortex flows generated by the vortex flow grooves of the fixed blade part, thereby allowing the grinded object to be grinded to the particle sizes in the range between 200 μm and 2000 μm, but failing to grind them to the particle sizes less than 200 μm.

Generally, a jet mill includes producing means for generating high pressure air, a body connected to the producing means and having a grinding chamber formed at the interior thereof, and injection nozzles spaced apart from each other along the body to inject the high pressure air moved from the producing means into the grinding chamber of the body and thus to generate swirling movements.

In case of such jet mills, however, the injection nozzles are located protrudedly from the body toward the inside of the grinding chamber, so that the protruded portions of the injection nozzles are easily abraded during the grinding of waste aluminum due to a high degree of softness of aluminum, which inconveniently causes frequent exchange of the injection nozzles.

Generally, aluminum generates excessive heat upon particle collision and is easily melted by heat due to a high degree of softness, and so as to grind waste aluminum, thus, the same time-particle collision should be maximized and the heat generated during grinding should be effectively distributed and dissipated. In case where the jet mill is applied to the grinding of waste aluminum, accordingly, it has to be precisely designed to optimize the number of injection nozzles and the installation angles of the injection nozzles and thus to maximize the particle collision. However, the conventional jet mill is not designed in consideration of the properties of aluminum, and therefore, it is not adequate for aluminum grinding.

Accordingly, many studies should be definitely needed on the jet mill capable of grinding waste aluminum raw materials to particle sizes of 1000 μm.

FIG. 1 is a plan sectional view showing one example of conventional jet mills, which is disclosed in Korean Patent No. 10-0673976 (entitled 'swirling flow type jet mill').

A jet mill 900 (hereinafter referred to as conventional jet mill) as shown in FIG. 1 includes a grinding chamber 901, supply nozzles 903 and auxiliary nozzles 904 adapted to inject air into the grinding chamber 901, a discharge hole 905 formed at the center of the grinding chamber 901 to discharge fine particles therefrom, and spiral wings 907 equally spaced apart from each other on the concentric circle around the discharge hole 905.

The supply nozzles 903 and the auxiliary nozzles 904 are spaced apart from each other along the inner periphery of the grinding chamber 901 in such a manner as to have their injection direction located against the center of the grinding chamber 901, thereby forming the swirling flows of air in the interior of the grinding chamber 901 through the injection of air.

Further, each spiral wing 907 is reduced in radius from the center of the discharge hole 905 as it goes from the upper flow side end 907*a* to the lower flow side end 907*b*, so that the grinded object collide against each other by means of the spiral wings 907, thereby increasing the grinding efficiency.

According to the conventional jet mill 900, however, the high expensive supply nozzles 903 and auxiliary nozzles 904 are mounted along the outer peripheral side wall 909 forming the grinding chamber 901, which makes the manufacturing complicated and further increases the manufacturing cost.

According to the conventional jet mill 900, further, the nozzle holes of the supply nozzles 903 and the auxiliary nozzles 904 are not located toward the discharge hole 905 as the center of the grinding chamber 901, but just located against the discharge hole 905, so that no structure is made wherein the number of nozzles and the approach angles of air are optimized to maximize the generation of turbulent flows, thereby failing to improve the number of injection nozzles—the turbulent flow efficiency and also failing to grind the grinded object into the fine granules having particle sizes less than 1000 μm.

So as to manufacture the aluminum granules having the particle sizes less than 1000 μm, that is, the approach angles toward air of the nozzles 903 and 904 and the number of them should be optimized to generate active turbulent flows in the grinding chamber 901, but the conventional jet mill 900 does not suggest any technology on the above, thereby failing to induce maximum particle collision.

According to the conventional jet mill 900, furthermore, the grinded object introduced should have the particle sizes in the range between 20 mm and 30 mm so as to induce the collision of the grinded object introduced through the pressuring air, and therefore, before the grinding process is performed using the jet mill 900, a pre-treatment process (grinding) should be performed wherein the grinded object is grinded to the particle sizes in the range between 20 mm and 30 mm. In the conventional grinding procedure using the jet mill 900, accordingly, the pre-treatment process, wherein the grinded object is grinded to the particle sizes in the range between 20 mm and 30 mm, and the grinding process using the jet mill 900, wherein the grinded object having the particle sizes in the range between 20 mm and 30 mm grinded through the pre-treatment process is grinded to fine particle sizes, should be performed independently of each other, thereby making the manufacturing procedure complicated and further causing the manufacturing time to be delayed.

Accordingly, many methods and devices are proposed to grind the grinded object having the particle sizes more than 30 mm to the fine particle sizes less than 1000 μm, not by using the jet mill, but by using the well-known grinding apparatus (fixed blades and rotary blades) adopted in the pre-treatment process (grinding), but when the grinded object becomes waste aluminum having a high degree of softness, low melting point and excessive heat generated during particle collision, the particle collision of the grinded object cannot be optimized by using the well-known grinding apparatus grinding the grinded object by the particle collision of the grinded object through the fixed blades and the rotary blades. Accordingly, there is an urgent need for the development and study on a new grinding apparatus capable of grinding waste aluminum into the fine granules having the particle sizes less than 1000 μm, not by using both of the pre-treatment process and the conventional jet mill.

That is, there is a definite demand for the development and study on a new grinding apparatus capable of grinding waste aluminum having the particle sizes more than 30 mm into the fine granules having the particle sizes in the range between 100 μm and 1000 μm and further effectively distributing and dissipating the heat generated during the grinding in consideration of the properties of the aluminum.

SUMMARY OF THE INVENTION

Accordingly, the present invention has been made in view of the above-mentioned problems occurring in the prior art, and it is an object of the present invention to provide a jet mill combining a high speed grinding apparatus and a high speed grinding apparatus with a jet mill mounted thereon wherein a plurality of injection holes injecting pressurizing air into the outside is spaced apart from each other on the center along the inner peripheral side wall of a jet mill body, without having any separate air nozzles, thereby saving manufacturing cost and providing simple manufacturing processes, and further, the number of injection holes is 10 to 14 and the approach angles toward air of the injection holes are limited in the range between 30° and 60°, thereby optimizing the particle collision of the grinded object and accordingly manufacturing the granules having fine particles less than 1000 μm.

It is another object of the present invention to provide a jet mill combining a high speed grinding apparatus and a high speed grinding apparatus with a jet mill mounted thereon wherein rotary blades and fixed blades are located in multiple stages to divide and grind object, and next, the grinded object passed through the rotary blades and the fixed blades is grinded to the particle sizes in the range between 100 μm and 1000 μm, thereby effectively distributing the heat generated during the grinding of aluminum and easily performing the grinding process, without stopping.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE INVENTION

Hereinafter, an explanation on a high speed grinding apparatus according to preferred embodiments of the present invention will be in detail given with reference to the attached drawing.

Figure 1:
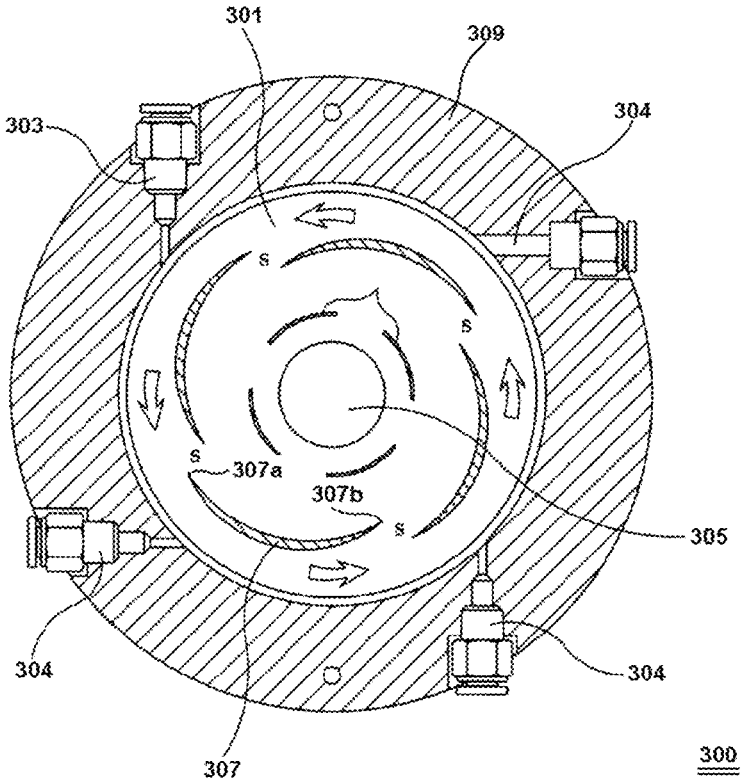
FIG. 1 (Prior Art)
FIG. 1 is a plan sectional view showing one example of conventional jet mills.
Figure 2:
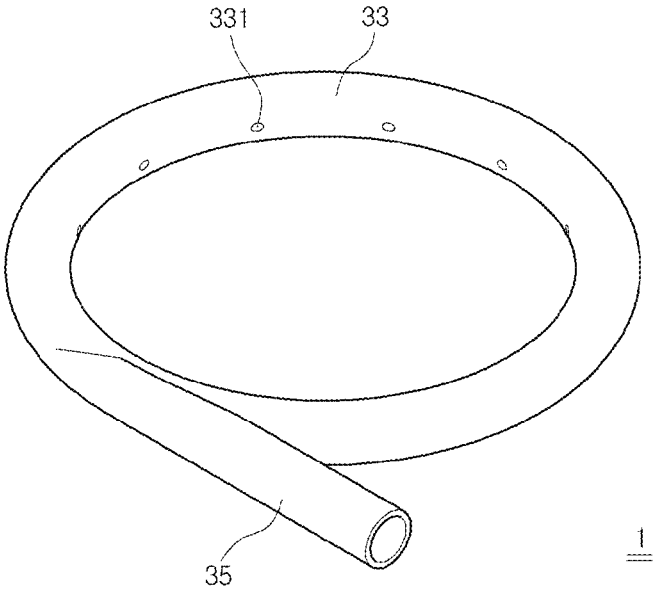
FIG. 2 is a perspective view showing a jet mill combining a high speed grinding apparatus adopted in the present invention.

FIG. 2 is a perspective view showing a jet mill combining a high speed grinding apparatus adopted in the present invention.

A jet mill 1 combining a high speed grinding apparatus as shown in FIG. 2 is combined with a high speed grinding apparatus according to a first embodiment of the present invention as will be described in FIG. 5.

Further, the jet mill 1 combining a high speed grinding apparatus is a device that injects pressurizing air supplied from pressurizing air producing means (not shown) into grinded object introduced thereinto to generate swirling movements, thereby allowing the particles of the grinded object to collide against each other and making them become granules having fine sizes.

Furthermore, the jet mill 1 combining a high speed grinding apparatus is formed of a shape of a pipe having a moving passage 333 formed at the interior thereof, along which the pressurizing air moves, and includes a body 33 having end portions connected to each other like a shape of a ring and an inlet portion 35 coupled to one side of the body 33 to introduce the pressurizing air into the moving passage 333 formed inside the body 33. At this time, the inlet portion 35 has a moving passage formed at the interior thereof, along which the pressurizing air moves, like the body 33, and the moving passage of the inlet portion 35 has one end portion connected to a connection passage connected to external pressurizing air producing means or pressurizing air producing means and the other end portion connectedly coupled to the moving passage 333 of the body 33, thereby allowing the pressurizing air supplied from the pressurizing air producing means to be introduced into the body 33.

The body 33 is formed of the pipe having the moving passage 333 formed at the interior thereof, along which the pressurizing air moves, and has the end portions coupled to each other like a ring in such a manner as to be open on both sides thereof. Accordingly, if the grinded object is introduced through one side open portion, the introduced grinded object is discharged through the other side open portion.

Further, the body 33 has a plurality of injection holes 331 spaced apart from each other on the center along the inner peripheral wall of the inner side thereof.

At this time, each injection hole 331 is formed on the inner peripheral wall of the body 33 at one end portion thereof and is connected to the moving passage 333 of the body 33 at the other end portion thereof, thereby injecting high pressure air passing through the moving passage 333 of the body 33 into the interior of the body 33 and thus generating the swirling movements in grinding space c defined by the inner peripheral wall of the body 33.

At this time, the number of injection holes 331 and the installation angles thereof will be in detail explained with reference to FIGS. 3 and 4 as will be discussed later.

The inlet 35 is connected to the external pressurizing air producing means at one side end portion thereof and connected to the moving passage 333 of the body 33 at the other side end portion thereof, thereby moving the pressurizing air supplied from the pressurizing air producing means to the moving passage 333 of the body 33.

Figure 3:
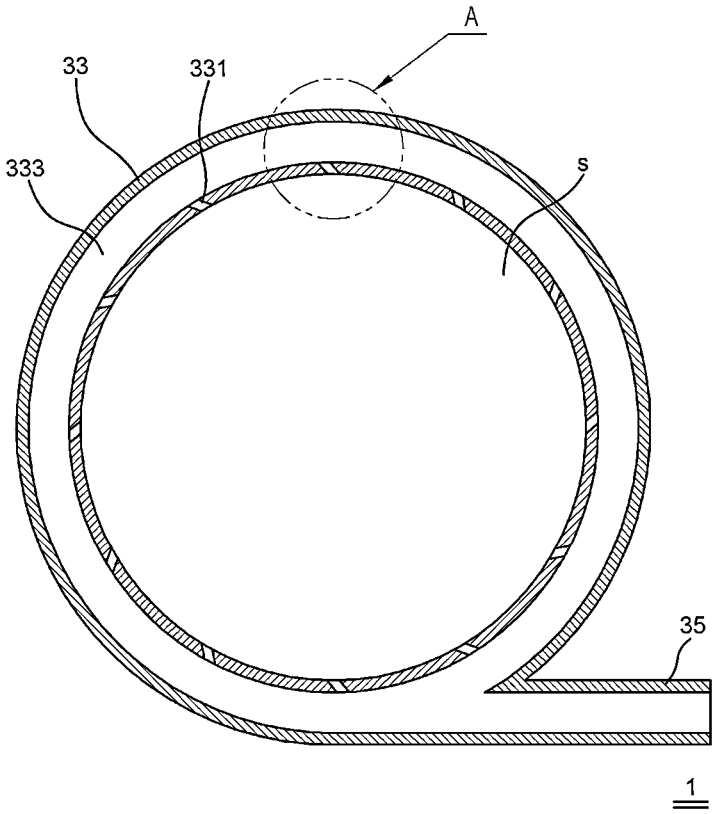
FIG. 3 is a plan view showing the jet mill combining a high speed grinding apparatus of FIG. 2, which is designed for grinding waste aluminum.
Figure 4:
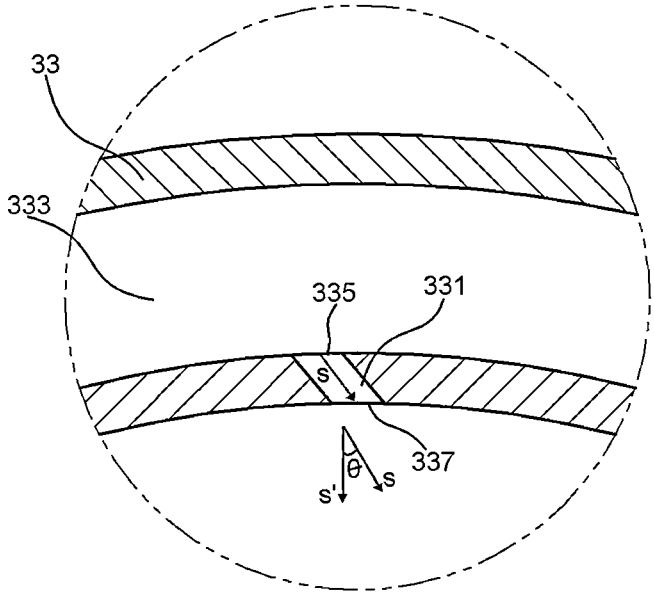
FIG. 4 is an enlarged view showing a portion A of FIG. 3.

FIG. 3 is a plan view showing the jet mill combining a high speed grinding apparatus of FIG. 2, which is designed for grinding waste aluminum, and FIG. 4 is an enlarged view showing a portion A of FIG. 3.

As shown in FIGS. 3 and 4, the jet mill 1 combining a high speed grinding apparatus adopted in the present invention is configured wherein the plurality of injection holes 331 is spaced apart from each other along the inner peripheral wall of the inner side thereof, each injection hole 331 being formed on the inner peripheral wall of the body 33 at one end portion thereof and connected to the moving passage 333 of the body 33 at the other end portion thereof, thereby injecting high pressure air passing through the moving passage 333 of the body 33 into the interior of the body 33 through the injection holes 331.

As shown in FIG. 4, further, each injection hole 331 is formed in such a manner as to allow an approach angle meaning the direction s from one side end portion 335 connected toward the moving passage 331 of the body 33 to the other side end portion 337 connected to the inner peripheral wall of the body 33 to be inclined by an arbitrary angle θ against the direction s' toward the center of a circle. That is, when viewed upwardly, the approach angles of the injection holes 331 are formed inclinedly by the arbitrary angle θ, which allows the pressurizing air to be injected inclinedly to the arbitrary angle θ and thus generating irregular turbulent flows more actively in the grinding space c.

Further, if the injection holes 331 having the same approach angles as each other are defined as one group, they should be contained in any one selected from the group having the approach angles of 30° and the group having the approach angles of 60°.

At this time, the injection hole 331 having the approach angles of 30° and the injection hole 331 having the approach angles of 60° are formed in turn, which optimizes the generation of the turbulent flows.

Desirably, the number of injection holes 331 contained in one group is the same as the number of injection holes 331 contained in the other group. In more detail, desirably, the total number of injection holes 331 is 12.

Accordingly, the jet mill 1 according to the present invention does not have any injection nozzles located in the conventional practice as the means for injecting the pressurizing air into the grinding space c, but has the plurality of injection holes 331, thereby saving manufacturing cost and further solving the conventional problems that the injection nozzles are easily worn out and exchanged due to the properties of aluminum having a high degree of softness.

Figure 5:
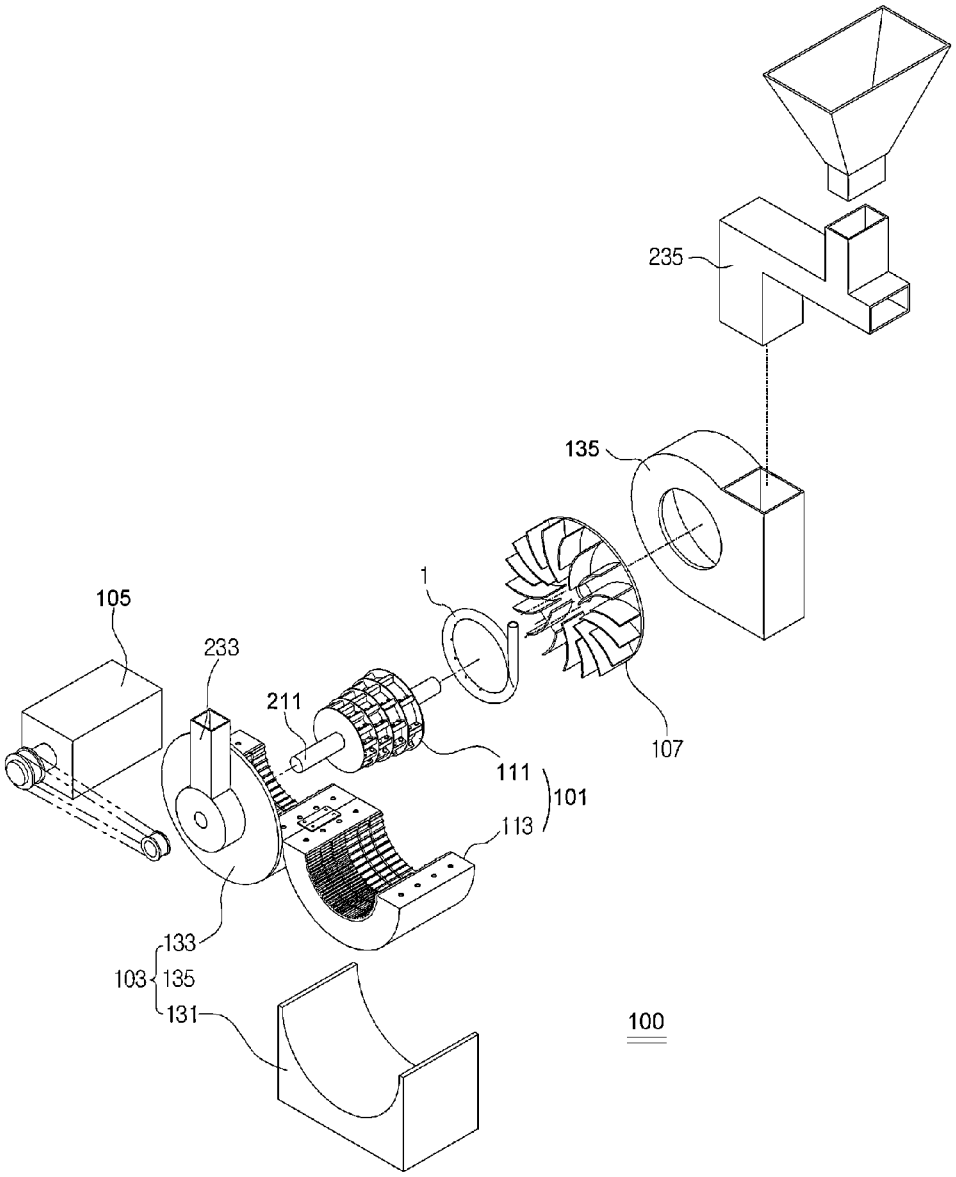
FIG. 5 is an exploded perspective view showing a high speed grinding apparatus according to a first embodiment of the present invention.

FIG. 5 is an exploded perspective view showing a high speed grinding apparatus according to a first embodiment of the present invention.

A high speed grinding apparatus 100 according to a first embodiment of the present invention is adapted to grind an object having particle sizes in the range between 6000 μm and 8000 μm, and especially to grind waste aluminum into the granules having particle sizes in the range between 100 μm and 1000 μm.

As shown in FIG. 5, the high speed grinding apparatus 100 according to the first embodiment of the present invention includes: a housing unit 103 having a support stand 131, an introduction part 133 and a discharge part 135 and adapted to fix and support the components of the apparatus 100; a grinding unit 101 coupled to the support stand 131 of the housing unit 103 and to grind the object being introduced to be grinded into the granules having the particle sizes in the range between 200 μm and 2000 μm through a rotary blade part 111 and a fixed blade part 113; a rotor 105 disposed spaced apart from the housing unit 103 and adapted to generate a rotary motion like a motor to allow the rotary blade part 111 of the grinding unit 101 to be rotated; the jet mill 1 combining a high speed grinding apparatus as shown in FIG. 2 disposed connectedly to the grinding unit 101 to grind the grinded object introduced from the grinding unit 101 into the granules having the particle sizes in the range between 100 μm and 1000 μm; and an impeller 107 disposed inside the discharge part 135 in such a manner as to be adjacent to the jet mill 1 to increase the flow of air passing the grinding unit 101.

Further, the high speed grinding apparatus 100 according to the first embodiment of the present invention includes cooling water supply means (not shown) adapted to supply cooling water to a first case 410 and a second case 420 as will be described in FIG. 9, which are not shown in FIG. 5.

The rotor 105 is means for generating a rotary motion, and desirably, the rotor 105 is a motor used commonly in production lines and processes.

Figure 6:
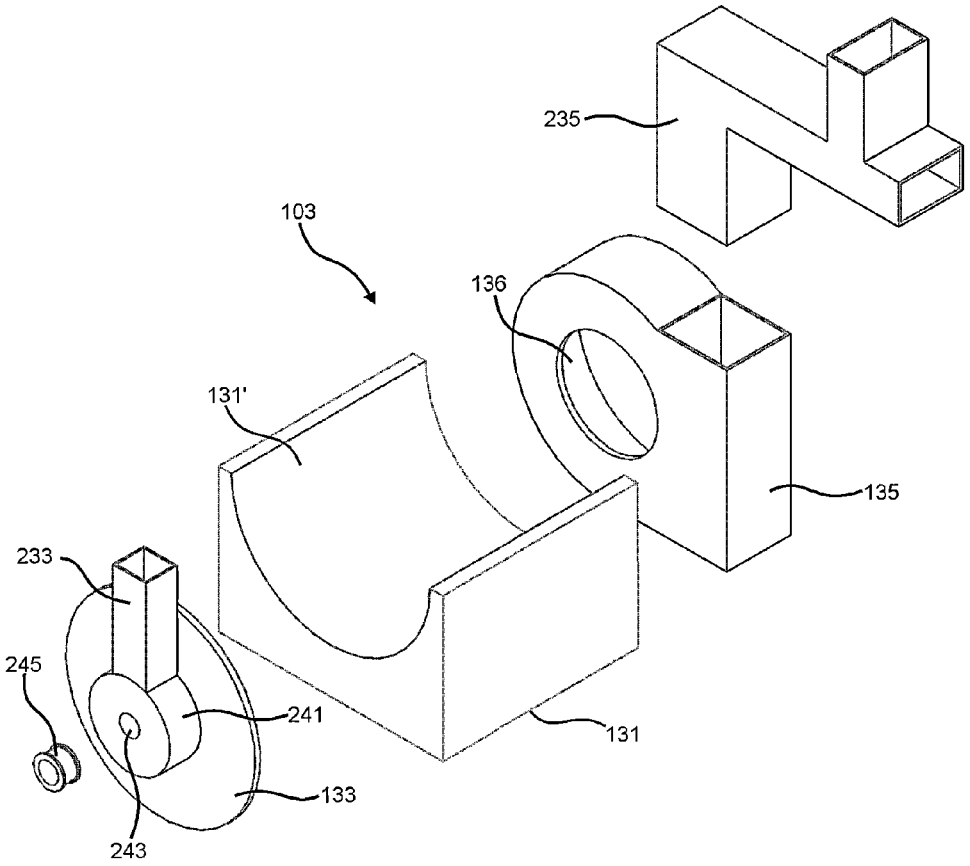
FIG. 6 is an exploded perspective view showing a housing unit of FIG. 5.

FIG. 6 is an exploded perspective view showing the housing unit of FIG. 5.

The housing unit 103 includes: the support rod 131 having a contact recess 131' curvedly formed inwardly on the upper portion surface thereof; the introduction part 133 coupled to one side of the support rod 131 in such a manner as to allow a rotary shaft 211 of the grinding unit 101 as will be described in FIG. 14 to be rotatably coupled thereto; the discharge part 135 coupled to the other side of the support rod 131 in such a manner as to allow the impeller 107 as will be discussed in FIG. 7 to be mounted at the inside thereof; an introduction pipe 233 connected to one side of the introduction part 133 at the end portion thereof to introduce a secondarily grinded object into the grinding unit 101; and a discharge pipe 235 connected to one side of the discharge part 135 to discharge the grinded object (which is called a thirdly grinded object) grinded by the grinding unit 101 to the outside.

The support rod 131 is formed of a rectangular parallelepiped curved inwardly on the upper portion surface thereof, that is, having the contact recess 131' curved inwardly from both end portions toward the center line in the longitudinal direction thereof. The introduction part 133 is disposed on one side of the support rod 131 in the longitudinal direction of the support rod 131 and the discharge part 135 on the other side thereof. At this time, the shape of the contact recess 131' corresponds to the shape of the outer peripheral surface of the lower portion of the fixed blade part 113 of the grinding unit 101 in such a manner as to be contacted with the outer peripheral surface of the lower portion of the fixed blade part 113, thereby absorbing and releasing the impacts caused by the rotation and vibration of the grinding unit 101.

The introduction part 133 is formed of a disc-shaped plate and located vertically at one side of the support rod 131, that is, closes the side portions of the support rod 131 and the grinding unit 101.

Further, the introduction part 133, the disc-shaped plate has a protruding portion 241 protruded in the shape of a cylinder outwardly from one surface thereof (which is called outer surface) and a rotary shaft insertion hole 243 formed at the center of the protruding portion 241 to insert the rotary shaft 211 of the grinding unit 101 thereinto.

At this time, a bearing 245 is coupled to the end portion of the rotary shaft 211 protruded through the rotary shaft insertion hole 243 of the introduction part 133 and connected to the rotor 105 by means of connection means like a chain, so that the rotary shaft 211 of the grinding unit 101 can be rotated through the rotation of the rotor 105.

Further, the protruding portion 241 of the introduction part 133 is connected to the introduction pipe 233 into which the secondarily grinded object is introduced. At this time, as air is absorbed into the impeller 107 as will be discussed in FIG. 19, the grinded object introduced through the introduction pipe 233 is moved in the order of the introduction part 133, the grinding unit 101, the jet mill 1, the impeller 107, the discharge part 135 and the discharge pipe 235, and the heat generated during the grinding is air-cooled to prevent the grinded object as waste aluminum raw material from being melted during the grinding.

Even if not shown in the drawings, a distributer may be disposed on one surface located toward the grinding unit 101 in the high speed grinding apparatus 100. At this time, the distributer is generally used in the grinding apparatus and system, and therefore, an explanation on the distributer will be avoided for the brevity of the description.

The discharge part 135 is formed of a body having an opening 136 formed on one side surface thereof to insert the impeller 107 thereinto and has one side connected to the discharge pipe 235.

Further, the discharge part 135 is coupled to the other side of the support rod 131 in such a manner as to allow the opening 136 to be located toward the grinding unit 101 and to mount the impeller 107 at the inside of the opening 136. At this time, the impeller 107, through which the rotary shaft 211 of the grinding unit 101 is passed, is rotated through the rotation of the rotary shaft 211. As the impeller 107 is rotated, the air existing in front of the impeller 107 is absorbed into the impeller 107, and the absorbed air is discharged behind the impeller 107, thereby increasing the discharge pressure of the air.

That is, the discharge part 135 is coupled to the other side of the support rod 131 in such a manner where the opening 136 is separated by a given distance from the end portion of the rotary blade part 111 of the grinding unit 101, and accordingly, the secondarily grinded object introduced from the introduction pipe 233 is passed through the grinding unit 101 and moved to the impeller 107 by means of the operation of the impeller 107.

That is, the grinded object passing through the grinding unit 101 is moved toward the impeller 107 along the movement of the air through the impeller 107.

Further, the discharge part 135 has the other surface to which the rotary shaft 211 of the grinding unit 101 is rotatably coupled, which is not shown in the drawing. That is, one end portion of the rotary shaft 211 of the grinding unit 101 is coupled to the introduction part 133 and the other end portion thereof coupled to the discharge part 135.

Figure 7:
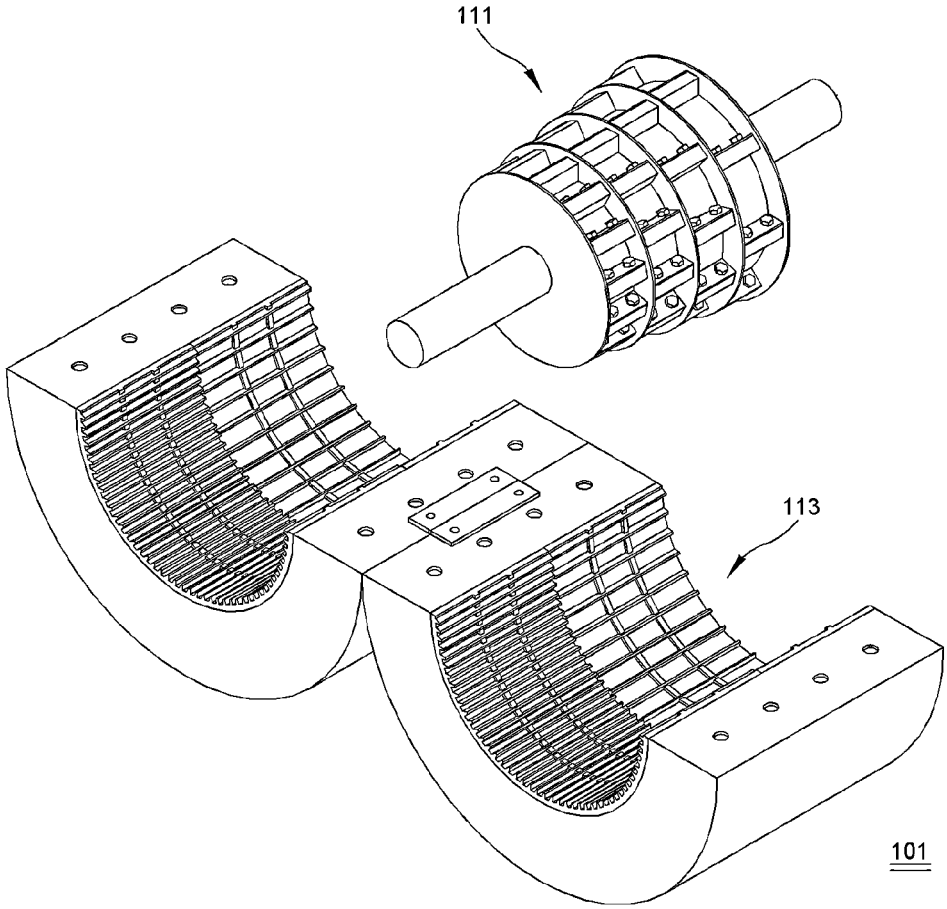
FIG. 7 is an exploded perspective view showing a grinding unit of FIG. 5.

FIG. 7 is an exploded perspective view showing the grinding unit of FIG. 5.

The grinding unit 101 is a device that generates swirling and vortex flow movements, induces the particle collision of the grinded object, and finally grinds the grinded object to fine particle sizes.

Further, the grinding unit 101 includes: the fixed blade part 113 having a plurality of fixed blades 411 formed on the inner peripheral surface thereof; and the rotary blade part 111 disposed inside the fixed blade part 113 and having a plurality of rotary blades 311 formed on the outer peripheral surface thereof and the rotary shaft 211 coupled along the center thereof, whereby the rotary blade part 111 is rotated through the rotation of the rotary shaft 211.

At this time, the jet mill 1 and the impeller 107 are fitted to the rotary shaft 211 coupled to the grinding unit 101, which is not shown in the drawing.

Figure 8:
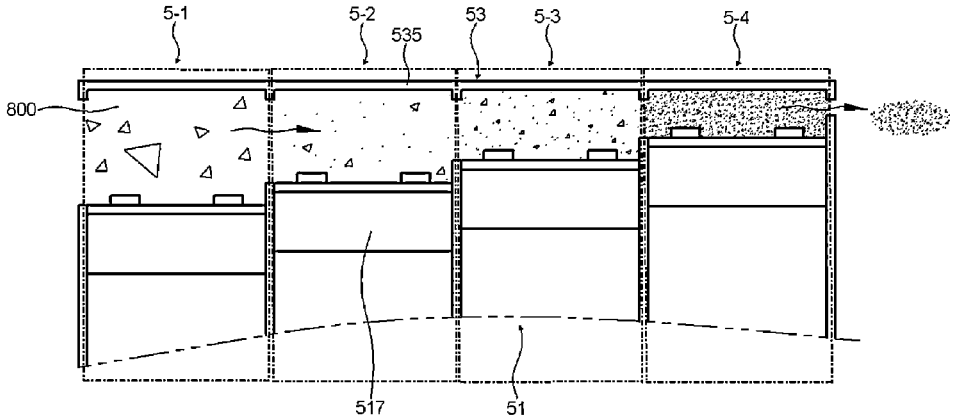
FIG. 8 is a side sectional perspective view showing the grinding unit of FIG. 7.

FIG. 8 is a side sectional perspective view showing the grinding unit of FIG. 7.

As shown in FIG. 8, the grinding unit 101 has the rotary blade part 111 rotatably coupled inside the fixed blade part 113 in such a manner as to be spaced apart from the fixed blade part 113, thereby forming a given space 800 between the fixed blade part 113 and the rotary blade part 111.

At this time, the given space 800 formed between the fixed blade part 113 and the rotary blade part 111 is called chamber, and the grinded object introduced form the introduction pipe 233 is passed through the chamber 800 and moved to the impeller 107.

So as to solve the problem that waste aluminum is melted due the excessive heat generated in one time grinding process, like this, the grinding unit 101 performs the grinding process through four stages. At this time, the four-stage grinding process of the grinding unit 101 is explained for the convenience of the description, but of course, five-stage grinding process thereof may be adopted.

If the fixed blade part 113 and the rotary blade part 111 located on a concentric circle with respect to the rotary shaft 211 are defined as one stage, a first stage grinding portion 5-1 grinds the grinded object initially introduced to particle sizes in the range between 5 mm and 6 mm, a second stage grinding portion 5-2 grinds the grinded object discharged from the first stage grinding portion 5-1 to particle sizes in the range between 3 mm and 5 mm, a third stage grinding portion 5-3 grinds the grinded object discharged from the second stage grinding portion 5-2 to particle sizes in the range between 2 mm and 3 mm, and a fourth stage grinding portion 5-4 grinds the grinded object discharged from the third stage grinding portion 5-3 to particle sizes in the range between 0.2 mm and 2 mm.

Figure 9:
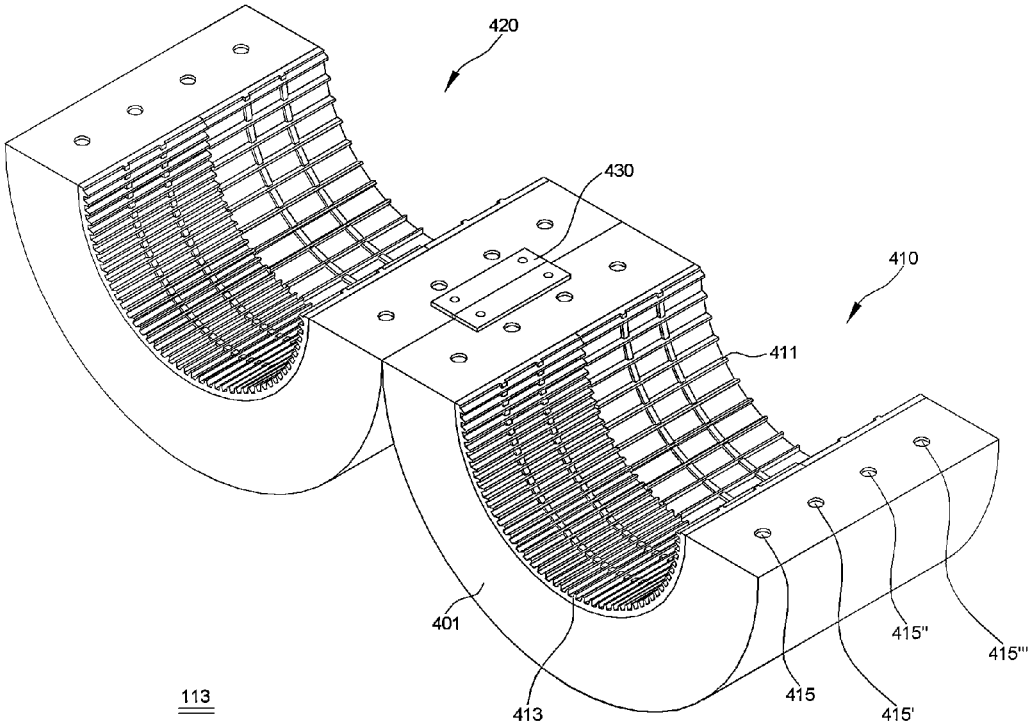
FIG. 9 is a perspective view showing a fixed blade part of FIG. 8.
Figure 10:
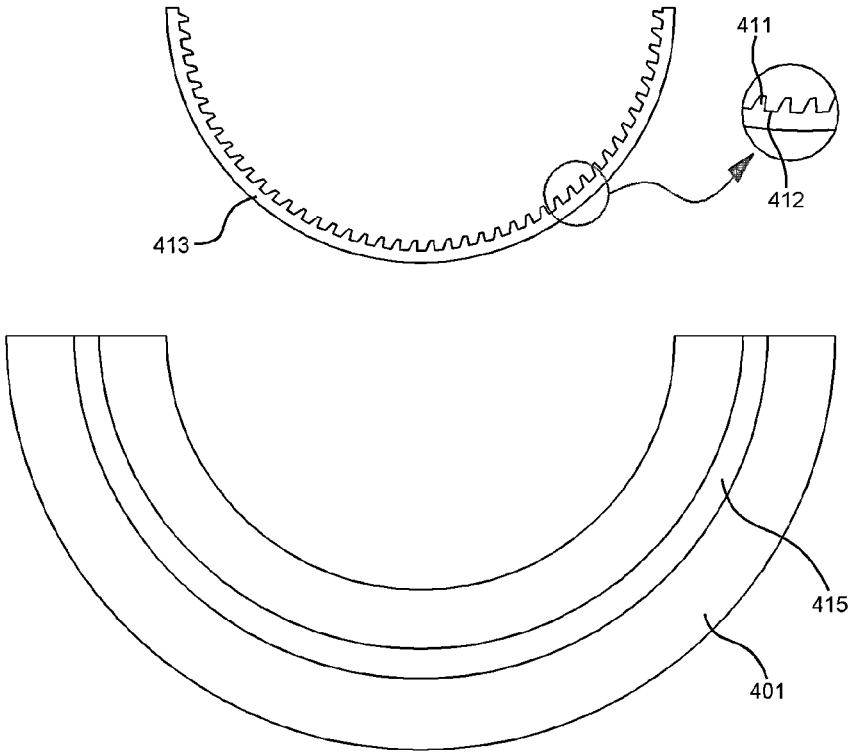
FIG. 10 is a front view showing the fixed blade part of FIG. 9.

FIG. 9 is a perspective view showing a fixed blade part of FIG. 8, and FIG. 10 is a front view showing the fixed blade part of FIG. 9.

As shown in FIGS. 9 and 10, the fixed blade part 113 includes: the first case 410 and the second case 420 forming a shape of a cylinder having a hollow portion when coupled to each other; and coupling means 430 adapted to hinge-couple the first case 410 and the second case 420 to each other. In this case, the outer peripheral surface of the lower portion of the first case 410 forming the lower portion of the fixed blade part 113 is located on the contact recess 131' of the support rod 131.

That is, while the first case 410 and the second case 420 are facing each other, they are hinge-coupled to each other by means of the coupling means 430 in such a manner as to be open and closed. At this time, the rotary blade part 111 is insertedly located into the hollow portion formed between the first case 410 and the second case 420.

Further, the outer peripheral surface of the lower portion of the first case 410 is located contacted with the contact recess 131' of the support rod 131, so that device checking and part exchanging can be easily performed just by opening the second case 420 from the first case 410.

Like this, when the first case 410 and the second case 420 are coupled to each other, they have the hollow portion formed thereinto in the longitudinal direction thereof, into which the rotary blade part 111 are insertedly located.

The first case 410 has a case body 401 having a curved recess formed on one surface thereof and a plurality of cooling passages 415, 415', 415", and 415'" formed passed through the interior of the arch, and a fixed blade plate 413 disposed in such a manner as to be contacted with the inner peripheral surface of the case body 401. At this time, the plurality of fixed blades 411 is formed on the inner peripheral surface of the fixed blade plate 413 in the parallel direction to the longitudinal direction of the support rod 131.

In more detail, the cooling passages 415, 415', 415", and 415'" are spaced apart from each other in such a manner as to be formed passed through the interior of the case body 401, along which the cooling water introduced from the cooling water supply means (not shown) is moved. The distances between the neighboring cooling passages 415, 415', 415", and 415'" correspond to the distances between first to fourth rotary blade arrangements a, b, c and d of the rotary blade part 111 as will be discussed later, thereby effectively performing the water cooling type heat dissipation in each stage. Further, the cooling passages 415, 415', 415", and 415'" formed in the case body 401 of the first case 410 are connected correspondingly to the cooling passages formed in the case body 401 of the second case 420 when the first case 410 and the second case 420 are coupled to each other.

The fixed blade plate 413 has a "U"-shaped sectional area in such a manner as to be contacted with the inner peripheral surface of the case body 401.

Further, the fixed blade plate 413 has the fixed blades 411 formed on the inner peripheral surface thereof in parallel direction to the longitudinal direction of the support rod 131 and vortex flow grooves 412 formed between the fixed blades 411 adjacent to each other on the same arch as each other to generate vortex flows therefrom.

The second case 420 has the same shape and configuration as the first case 410.

Figure 11:
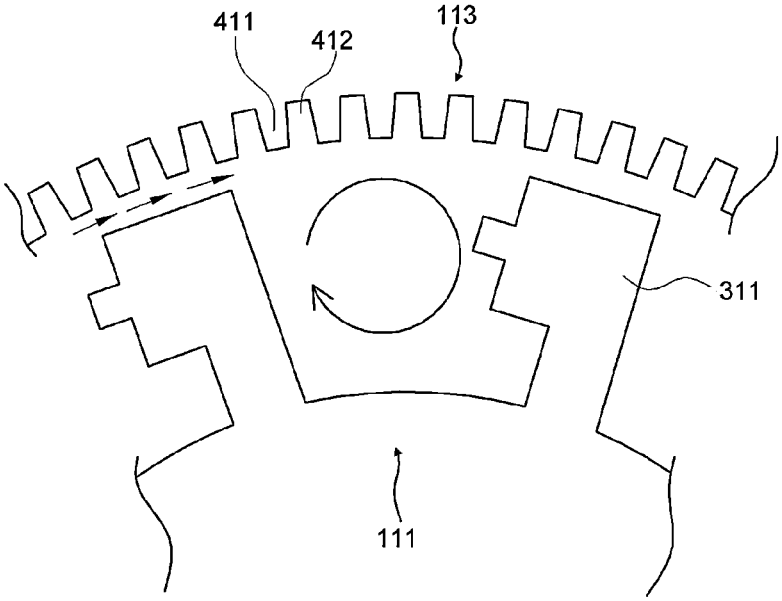
FIG. 11 is an exemplary view showing the vortex flows generated by the vortex flow grooves of FIG. 10.

FIG. 11 is an exemplary view showing the vortex flows generated by the vortex flow grooves of FIG. 10.

FIG. 11 is a sectional view showing the state wherein the grinding part 101 cuts off in the width direction thereof, and referring to FIG. 11, the grinding principle of the grinding unit 101 will be explained. If the rotary blades 311 of the rotary blade part 111 located at the inside of the fixed blade part 113 are rotated to generate a rotary motion, the air existing between the fixed blades 411 and the rotary blades 311 is moved to the vortex flow grooves 412 through the rotating force of the rotary blades 311.

Next, if the air is introduced into the vortex flow grooves 412, the introduced air is reflected to generate strong vortex flows therefrom, thereby allowing the particle collision of the introduced grinded object to be activated and grinding the grinded object into the granules having fine particle sizes.

Figure 12:
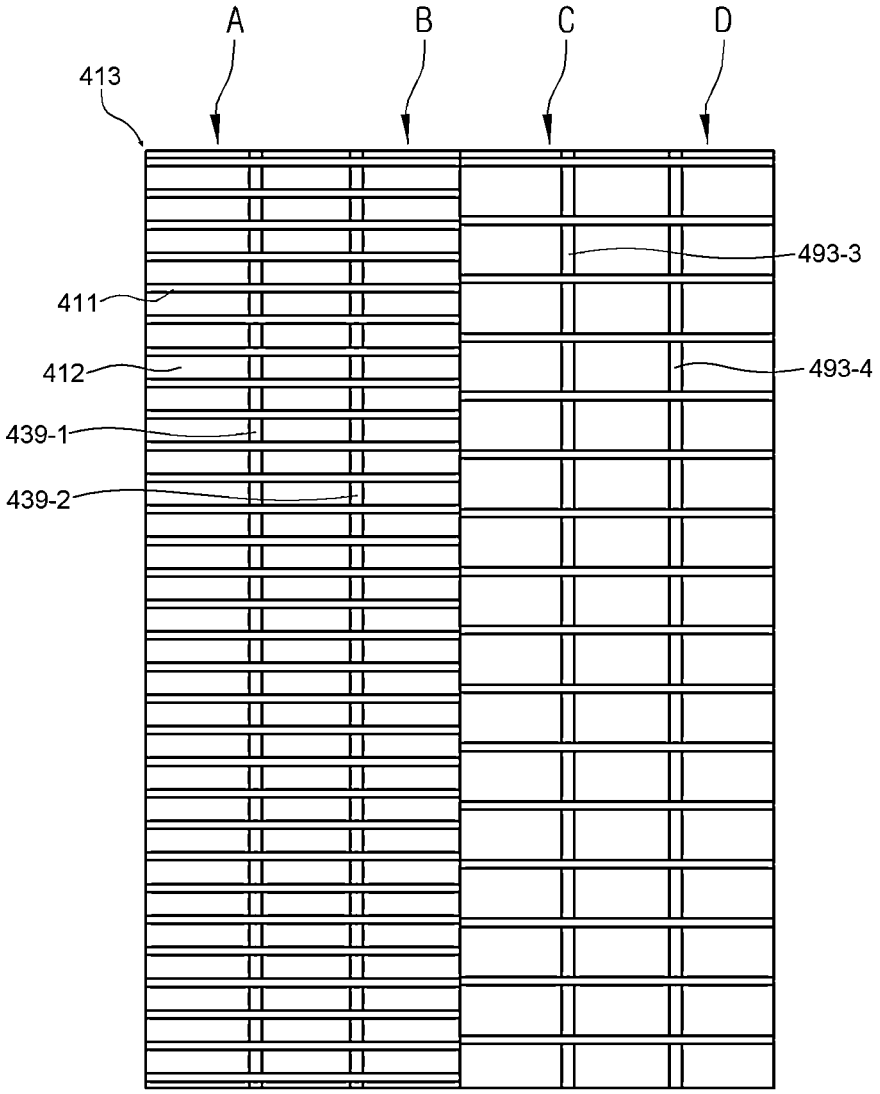
FIG. 12 is a plan view showing a fixed blade plate of FIG. 9.

FIG. 12 is a plan view showing the fixed blade plate of FIG. 9.

The fixed blade plate 413 has the fixed blades 411 formed on the inner peripheral surface thereof and the vortex flow grooves 412 formed between the neighboring fixed blades 411 on the same arch as each other.

Further, the fixed blade part 413 has locking protrusions 439-1, 439-2, 439-3 and 439-4 protruded from the inner peripheral surface thereof in such a manner as to be connected to each other along the arch.

Furthermore, if the fixed blades 411 and the vortex flow grooves 412 formed on the same arch as each other are defined as one arrangement, the fixed blade plate 413 has two arrangements.

At this time, the fixed blades 411 and the vortex flow grooves 412 formed on the concentric circle in the direction adjacent to the introduction part 133 are formed on first and second fixed blade arrangements A and B, and contrarily, the fixed blades 411 and the vortex flow grooves 412 formed on the concentric circle in the direction adjacent to the discharge part 135 are formed on third and fourth fixed blade arrangements C and D.

At this time, the first, second, third and fourth fixed blade arrangements A, B, C and D correspond to the first stage grinding portion 5-1, the second stage grinding portion 5-2, the third stage grinding portion 5-3 and the fourth stage grinding portion 5-4 as mentioned above.

That is, the secondarily grinded object introduced into the grinding unit 101 is passed through the grinding unit 101 in the order of the first fixed blade arrangement A, the second fixed blade arrangement B, the third fixed blade arrangement C and the fourth fixed blade arrangement D.

The fixed blades 411 and the vortex flow grooves 412 forming the third and fourth fixed blade arrangements C and D are smaller in number than those forming the first and second fixed blade arrangements A and B, so that the vortex flows generated from the third and fourth fixed blade arrangements C and D are more decreased than those generated from the first and second fixed blade arrangements A and B.

For the convenience of the description, at this time, the first and second fixed blade arrangements A and B have the same number of fixed blades and vortex flow grooves, and the third and fourth fixed blade arrangements C and D have the same number of fixed blades and vortex flow grooves. However, the first to fourth fixed blade arrangements A to D may be decreased in the number of fixed blades and vortex flow grooves along the moving passage of the grinded object.

Referring to FIG. 8, an explanation on the reason why the number of the fixed blades 411 is decreased along the fixed blade arrangements will be given. The grinding unit 101 is configured to allow the volume of the chamber 800 formed in each of the first to fourth stage grinding portions 5-1 to 5-4 to be increased along the moving passage of the grinded object, but the decrement of the volume of the chamber 800 means the reduction of the space in which the grinding is conducted, so that as the volume of the chamber 800 is decreased, a load generation probability when the same amount of grinded object is grinded is increased.

Accordingly, the number of vortex flow grooves 412 and fixed blades 411 is adjusted in proportion to the volume of the chamber 800 corresponding to each of the first to fourth stage grinding portions 5-1 to 5-4, thereby effectively preventing the load generated during the grinding.

That is, the number of vortex flow grooves 412 and fixed blades 411 formed on the first and second fixed blade arrangements A and B corresponding to the first and second stage grinding portions 5-1 and 5-2 having the chambers 800 larger in volume than the third and fourth stage grinding portions 5-3 and 5-4 is larger than that formed on the third and fourth fixed blade arrangements C and D, thereby conducting particle collision more actively, and contrarily, the number of vortex flow grooves 412 and fixed blades 411 formed on the third and fourth fixed blade arrangements C and D corresponding to the third and fourth stage grinding portions 5-3 and 5-4 having the chambers 800 smaller in volume than the first and second stage grinding portions 5-1 and 5-2 is smaller than that formed on the first and second fixed blade arrangements A and B, thereby suppressing the particle collision and minimizing the generation of the load.

According to the present invention, the grinding is conducted in multiple stages 5-1 to 5-4 in accordance with the properties of aluminum granules generating excessive heat upon particle collision, which distributes the generated heat effectively, and further, the number of fixed blades and vortex flow grooves is appropriately adjusted in accordance with the volume of the chamber of each stage, which minimizes the generation of the load.

The locking protrusions 439-1 and 439-2 are formed connected along the arch in such a manner as to be protruded from the inner peripheral surface of the fixed blade plate 413 forming the first and second fixed blade arrangements A and B, and the locking protrusions 439-3 and 439-4 are formed connected along the arch in such a manner as to be protruded from the inner peripheral surface of the fixed blade plate 413 forming the third and fourth fixed blade arrangements C and D.

The locking protrusions 439-1 to 439-4 are protruded from the inner peripheral surface of the fixed blade plate 413 to suppress the movement of the secondarily grinded object when the secondarily grinded object is moved through the flow of air and thus to prevent the grinded object not grinded to a desired particle size from being easily moved to the next stage grinding portion.

That is, the locking protrusions 439-1 to 439-4 are adapted to prevent the grinded object not grinded to a desired particle size in the respective first to fourth stage grinding portions 5-1 to 5-4 due to the properties of aluminum having strong softness and the flow of air from being easily moved to the next stage grinding portion, so that the grinded object grinded in the respective chambers 800 of the first to fourth stage grinding portions 5-1 to 5-4 is grinded to the desired particle size and moved to the next stage grinding portion.

Further, the fixed blade part 113 is formed along the four stage fixed blade arrangements A to D, and as the shapes of the vortex flow grooves 412 formed on the respective fixed blade arrangements A to D are changed, an amount of particle collision of the grinded object can be adjusted when the grinded object enters the space between the respective fixed blade arrangements A to D and the rotary blade part 111. A method for controlling the particle collision through the change of the shapes of the vortex flow grooves 412 contained in the respective fixed blade arrangements A to D will be described with reference to FIGS. 13*a* and 13*b*.

Figure 13A:
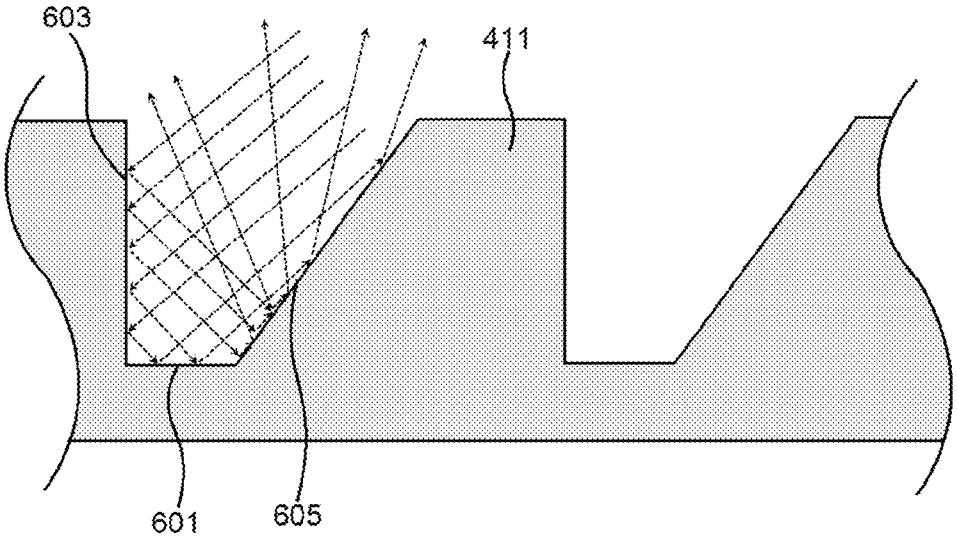
FIG. 13*a* is a side view showing the vortex flow grooves in the shape of '⅃/'.
Figure 13B:
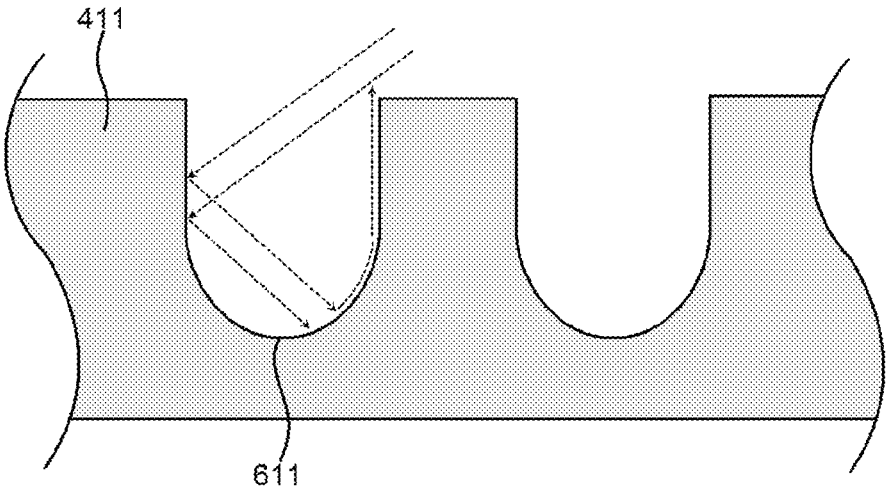
FIG. 13*b* is a side view showing the vortex flow grooves in the shape of 'U'.

FIG. 13*a* is a side view showing the vortex flow grooves in the shape of '⋁', that is, a sawtoothed or serrate shape, and FIG. 13*b* is a side view showing the vortex flow grooves in the shape of 'U'.

Each of the first, second, third and fourth fixed blade arrangements A, B, C and D contains the plurality of vortex flow grooves 412 formed along the inner peripheral surface of the fixed blade plate 413.

At this time, as shown in FIG. 13*a*, vortex flow grooves 601 having the shape of '⋁' are formed on the first and second fixed blade arrangements A and B, and as shown in FIG. 13*b*, vortex flow grooves 611 having the shape of 'U' are formed on the third and fourth fixed blade arrangements C and D.

Each vortex flow groove 601 having the shape of '⋁' formed on the first and second fixed blade arrangements A and B is formed in such a manner that the air introduced through the rotation of the rotary blades 311 collides against a vertical facing surface 603, and next, the colliding air is reflected and collides against a slant surface 605, thereby causing scattered reflection.

However, each vortex flow groove 601 having the shape of 'U' formed on the third and fourth fixed blade arrangements C and D is formed in such a manner that the air introduced through the rotation of the rotary blades 311 is moved along the curved surface thereof, which causes an amount of scattered reflection smaller than the vortex flow groove 601 having the shape of '⅂' and thus makes the particle collision of the grinded object decreased.

According to the present invention, accordingly, the fixed blade part 113 is formed of the plurality of fixed blade arrangements A, B, C and D, and the particle collision is controlled through the change of the shapes of the vortex flow grooves 412 contained in the respective fixed blade arrangements A, B, C and D, thereby more effectively minimizing the load generated during the grinding.

Figure 14:
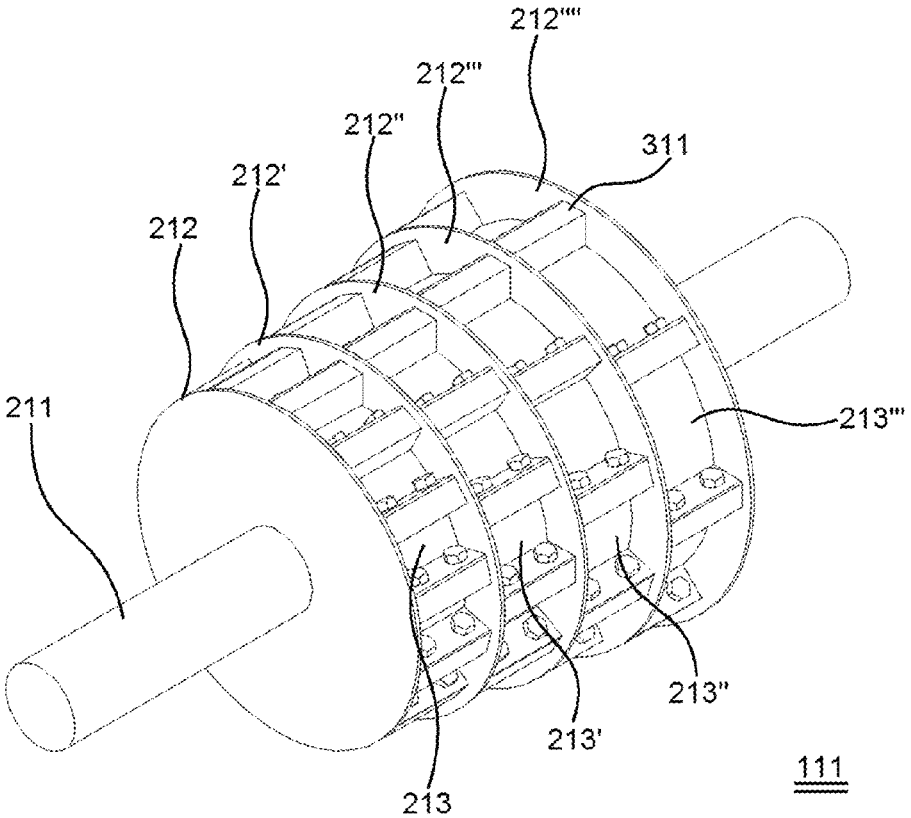
FIG. 14 is a perspective view showing a rotary blade part of FIG. 9.
Figure 15:
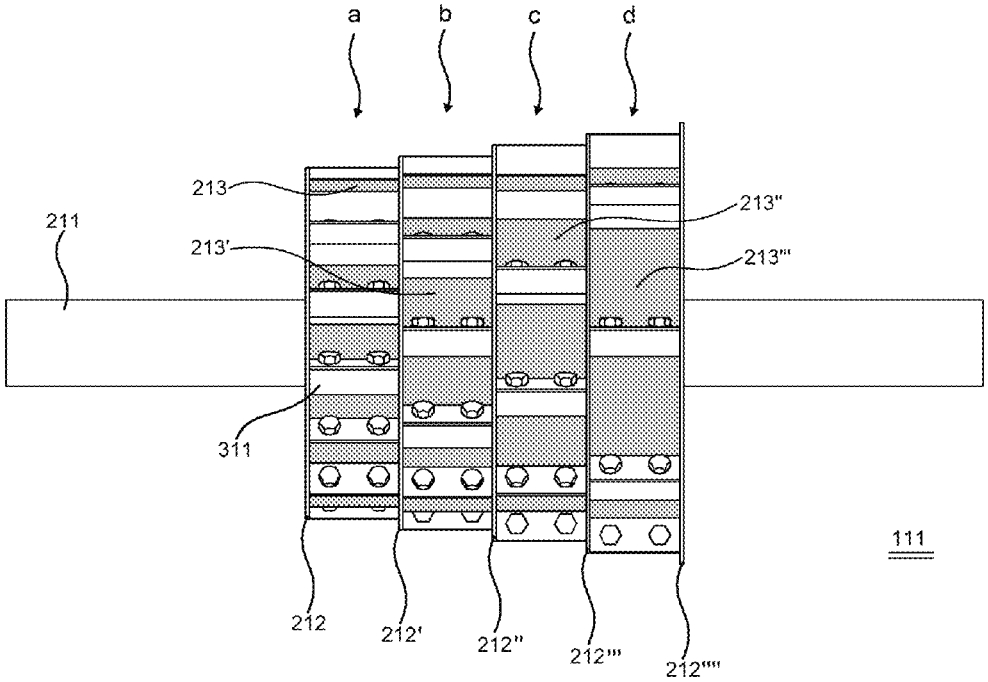
FIG. 15 is a side view showing the rotary blade part of FIG. 14.

FIG. 14 is a perspective view showing the rotary blade part of FIG. 5, and FIG. 15 is a side view showing the rotary blade part of FIG. 14.

As shown in FIGS. 14 and 15, the rotary blade part 111 includes: the rod-shaped rotary shaft 211 as a main shaft rotated through the rotation of the rotor 105; first, second, third, fourth and fifth locking plates 212, 212', 212", 212''' and 212'''' spaced apart from each other in such a manner as to be fit to the rotary shaft 211; first, second, third and fourth rotary bodies 213, 213', 213" and 213''' located between the neighboring first, second, third, fourth and fifth locking plates 212, 212', 212", 212''' and 212''''; and the plurality of rotary blades 311 mounted on the outer peripheral surfaces of the first, second, third and fourth rotary bodies 213, 213', 213" and 213''', and as mentioned above, the impeller 107 is coupled to the rotary shaft 211 at the location adjacent to the fifth locking plate 212'''', while being separated by a given distance therefrom. At this time, both end portions of the rotary shaft 211 of the grinding unit 101 are coupled to the introduction part 133 and the discharge part 135, and the first, second, third, fourth and fifth locking plates 212, 212', 212", 212''', and 212'''' are located inside the fixed blade part 113, while the impeller 107 is being located inside the opening of the discharge part 135.

For the convenience of the description, at this time, the first rotary body 213 and the rotary blades 311 located between the first locking plate 212 and the second locking plate 212' are contained in a first rotary blade arrangement a, the second rotary body 213' and the rotary blades 311 located between the second locking plate 212' and the third locking plate 212" in a second rotary blade arrangement b, the third rotary body 213" and the rotary blades 311 located between the third locking plate 212" and the fourth locking plate 212'''' in a third rotary blade arrangement c, and the fourth rotary body 213''' and the rotary blades 311 located between the fourth locking plate 212''' and the fifth locking plate 212'''' in a fourth rotary blade arrangement d.

Each first, second, third, fourth and fifth locking plates 212, 212', 212", 212''' and 212'''' has the shape of a disc having a hollow portion formed on the center thereof, along which the rotary shaft 211 is insertedly coupled.

Further, the first, second, third, fourth and fifth locking plates 212, 212', 212", 212''' and 212'''' are gradually increased in area as they go from the first locking plate 212 toward the fifth locking plate 212'''', so that the respective distances (hereinafter, referred to as the distance from the fixed blades) between the fixed blades 411 of the fixed blade plate 413 and the end portions of the first to fifth locking plates are decreased gradually as they go from the first locking plate 212 toward the fifth locking plate 212''''. In more detail, desirably, the distance of the second locking plate 212' from the fixed blades 411 is 6 mm, the distance of the third locking plate 212" from the fixed blades 411 is 5 mm, the distance of the fourth locking plate 212''' from the fixed blades 411 is 3 mm, and the distance of the fifth locking plate 212'''' from the fixed blades 411 is 2 mm.

That is, the first, second, third, fourth and fifth locking plates 212, 212', 212", 212''' and 212'''' are gradually increased in area along the moving passage of the grinded object, while their distances from the fixed blades 411 are being gradually decreased, so that only when the grinded object grinded on the first stage grinding portion 5-1 is grinded to particle sizes smaller than the distance of the second locking plate 212' from the fixed blades 411, they can be moved to the next grinding portion, that is, the second stage grinding portion 5-2.

Each first, second, third and fourth rotary bodies 213, 213', 213" and 213''' has the shape of a cylinder having the center coupled to the rotary shaft 211. The first rotary body 213 is disposed between the first and second locking plates 212 and 212', the second rotary body 213' between the second and third locking plates 212' and 212", the third rotary body 213" between the third and fourth locking plates 212" and 212''', and the fourth rotary body 213''' between the fourth and fifth locking plates 212''' and 212''''.

Further, the first, second, third and fourth rotary bodies 213, 213', 213" and 213''' are gradually increased in their sectional area along the moving passage of the grinded object. That is, the first rotary body 213 is smaller than the second rotary body 213', the second rotary body 213' than the third rotary body 213", and the third rotary body 213" than the fourth rotary body 213'''.

Furthermore, the first, second, third and fourth rotary bodies 213, 213', 213" and 213''' have the rotary blades 311 mounted along the outer peripheral surfaces thereof.

Upon the mounting of the rotary blades 311, the first, second, third and fourth rotary bodies 213, 213', 213" and 213''' are formed in such a manner as to have diameters from the centers thereof to the end portions of the rotary blades 311 smaller than those of the second, third, fourth and fifth locking plates 212', 212", 212''', and 212'''' located toward the discharge part 135 among the locking plates contacted therewith.

At this time, the first, second, third and fourth rotary blade arrangements a, b, c and d correspond to the first, second, third and fourth fixed blade arrangements A, B, C and D and the cooling passages 415, 415', 415" and 415''' of the first and second cases 410 and 420, so that the high speed grinding apparatus 100 can grind the aluminum into aluminum granules having fine particle sizes in the range between 200 μm and 2000 μm in multiple stages.

Figure 16:
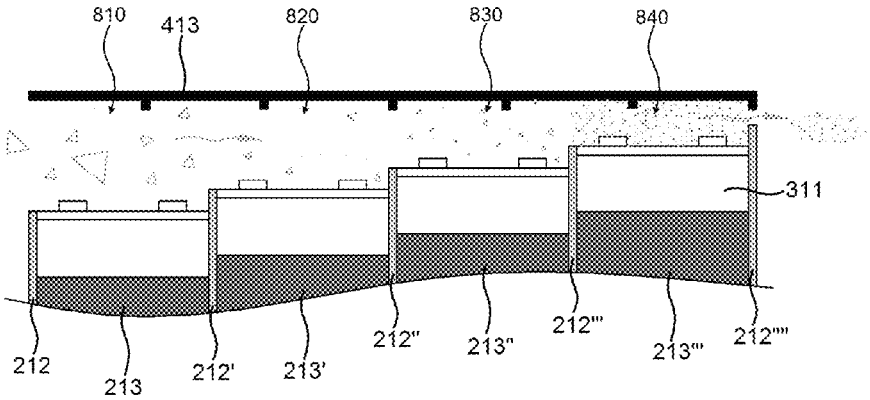
FIG. 16 is an exemplary view showing the grinding unit of FIG. 7.

FIG. 16 is an exemplary view showing the grinding unit of FIG. 7.

As shown in FIG. 16, when the fixed blade part 113 and the rotary blade part 111 of the grinding unit 101 are coupled to each other, they form chambers along which the grinded object introduced through the introduction part 133 is moved. At this time, the chamber defined by the first fixed blade arrangement A and the first rotary blade arrangement a is called a first chamber 810, the chamber defined by the second fixed blade arrangement B and the second rotary blade arrangement b a second chamber 820, the chamber defined by the third fixed blade arrangement C and the third rotary blade arrangement c a third chamber 830, and the chamber defined by the fourth fixed blade arrangement D and the fourth rotary blade arrangement d a fourth chamber 840.

Further, the first, second, third and fourth chambers 810, 820, 830 and 840 are contained in the corresponding first to fourth stage grinding portions 5-1, 5-2, 5-3 and 5-4.

Further, the first, second, third and fourth chambers 810, 820, 830 and 840 are gradually decreased in sizes as they go from the first chamber 810 toward the fourth chamber 840 since the sizes of the first, second, third and fourth rotary bodies 213, 213', 213" and 213'" are increased along the moving passage of the grinded object.

Among the grinded object grinded in the first chamber 810, that is, just the grinded object grinded to the particle sizes smaller than the distance of the second locking plate 212' from the fixed blades is moved to the second chamber 820, which is applied in the same manner as above to the second, third and fourth chambers 820, 830 and 840, thereby finally producing the aluminum granules having the particle sizes in the range between 0.2 mm and 2 mm.

Accordingly, the high speed grinding apparatus 100 according to the first embodiment of the present invention adopted in the high speed grinding process performs the grinding operation in the four-stage structure, thereby distributing the heat generated during the grinding, and further, the shapes of the fixed blades 411, the rotary blades 311 and the vortex flow grooves 412 are changed by each stage, thereby easily conducting the grinding operation to have desired particle sizes. Further, the water cooling type heat dissipation is performed by each stage in consideration of the properties of aluminum generating excessive heat upon the particle collision, thereby achieving effective heat dissipation.

Figure 17:
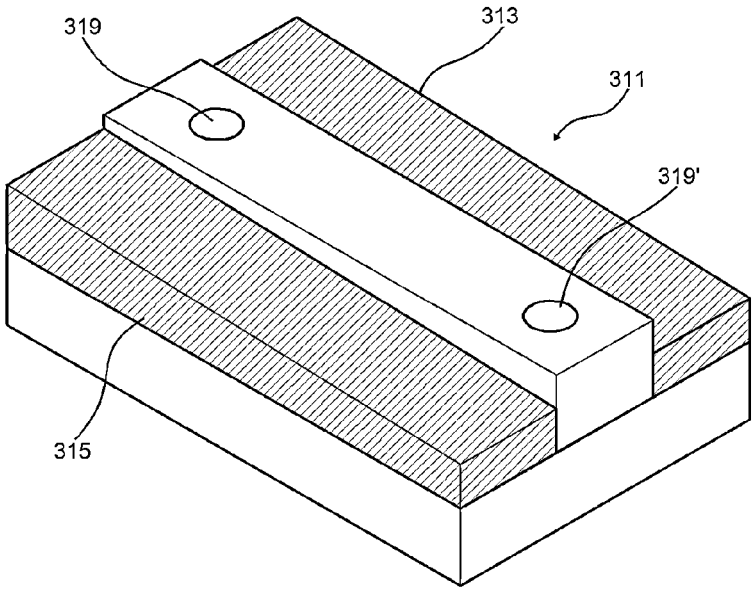
FIG. 17 is a perspective view showing the rotary blade of FIG. 14.
Figure 18:
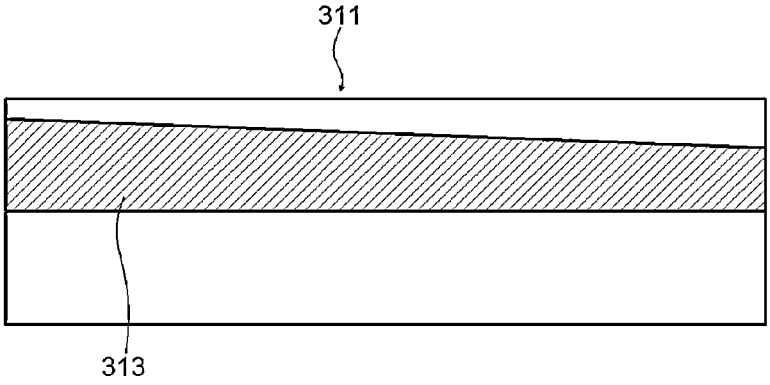
FIG. 18 is a side view showing the rotary blade of FIG. 17.

FIG. 17 is a perspective view showing the rotary blade of FIG. 14, and FIG. 18 is a side view showing the rotary blade of FIG. 17.

Each rotary blade 311 takes a shape of a rectangular parallelepiped and is bolt-fastened to the corresponding rotary body.

Further, the rotary blade 311 has bolt holes 319 and 319' formed on the center thereof to pass through both surfaces thereof, through which bolts are fastened. Also, the rotary blade 311 has blades 313 and 315 formed on both end portions thereof with respect to the bolt holes 319 and 319', so that if one side blade is worn out or damaged due to the contact with the grinded object, the other side blade is replaced with one side blade.

When viewed on plane, further, the blades 313 and 315 have the upper surfaces formed inclinedly from one side toward the other side thereof, so that when they are rotated through the rotation of the rotary body, turbulent flows may be optimized through the inclined upper surfaces to allow the particles of the grinded object to actively collide against each other.

If the upper surfaces of the blades 313 and 315 are formed flat, that is, the turbulent flows generated through the rotation of the blades 313 and 315 have given patterns, thereby failing to achieve active particle collision of the grinded object, and contrarily, if the upper surfaces of the blades 313 and 315 are formed inclined, the turbulent flows having various moving directions are generated through the inclined surfaces, thereby achieving active particle collision of the grinded object.

The grinded object, which is passed through the grinding unit 101 having the rotary blade part 111 and the fixed blade part 113, has the fine particle sizes in the range between 200 μm and 2000 μm, but there is a limitation in the particle collision of the grinded object caused by the turbulent flows formed by the rotation of the rotary blades 311 and the vortex flow grooves 412 of the fixed blade part 113, which makes it hard to grind the grinded object into the aluminum granules having the particle sizes less than 2000 μm.

Accordingly, the high speed grinding apparatus 100 according to the first embodiment of the present invention further includes the jet mill 1 combining the high speed grinding apparatus as mentioned in FIGS. 2 to 4, so as to grind the grinded object passed through the grinding unit 101 to fine particles.

The jet mill 1 combining the high speed grinding apparatus is designed to optimize the turbulent flows in the grinding space c, and accordingly, it can grind the grinded object having the particle sizes in the range between 200 μm and 2000 μm passed through the grinding unit 101 into those having the particle sizes in the range between 100 μm and 1000 μm.

Accordingly, the high speed grinding apparatus 100 according to the first embodiment of the present invention grinds the waste aluminum through the grinding unit 101 in multiple stages and further grinds the grinded object passed through the grinding unit 101 to finer particle sizes through the jet mill 1 combining the high speed grinding apparatus, thereby effectively distributing the heat generated by the collision between aluminum particles and grinding the waste aluminum having a high degree of softness to the particle sizes less than 1000 μm.

As the fixed blade part 113 is open and closed, further, the high speed grinding apparatus 100 according to the first embodiment of the present invention can easily perform checking and exchanging for the rotary blade part 111, the fixed blade part 113 and the jet mill 1 that exhibit serious abrasion by the properties of the aluminum having a high degree of softness.

Additionally, the high speed grinding apparatus 100 according to the first embodiment of the present invention is provided with the jet mill 1 that injects the pressurizing air through the injection holes to generate the swirling movements in the grinding space c, without having any separate injection nozzles, thereby solving the conventional problem that the process is not conducted well due to the abrasion of the injection nozzles and further saving the cost and time required for the manufacturing and checking. Instead of the installation of the injection nozzles, especially, the formation of the injection holes completely removes the disadvantages that the parts colliding against the particles of the grinded object are worn out due to the properties of the waste aluminum having a high degree of softness and low melting point.

Figure 19:
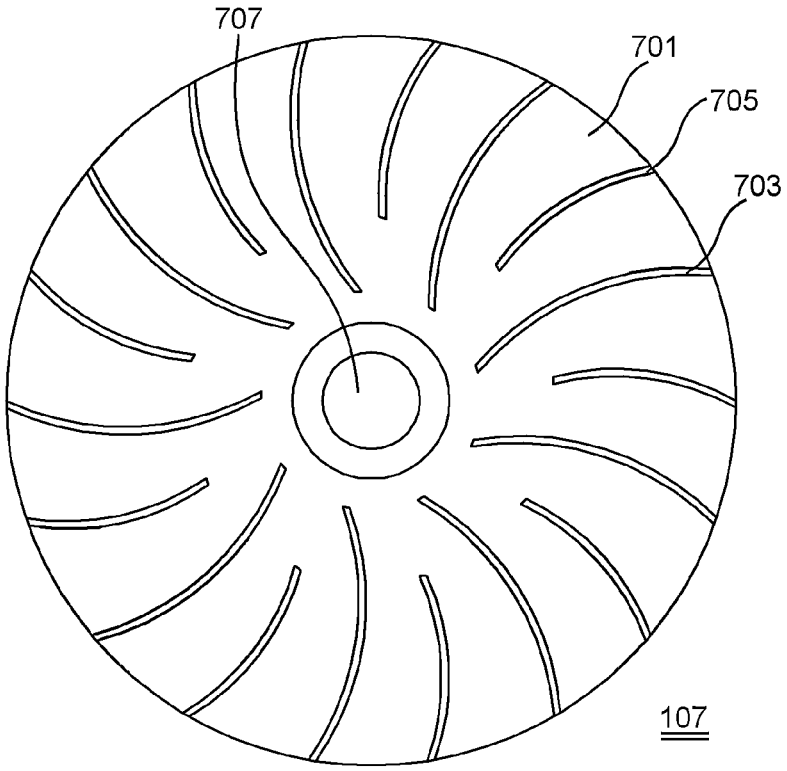
FIG. 19 is a plan view showing an impeller of FIG. 5.
Figure 20:
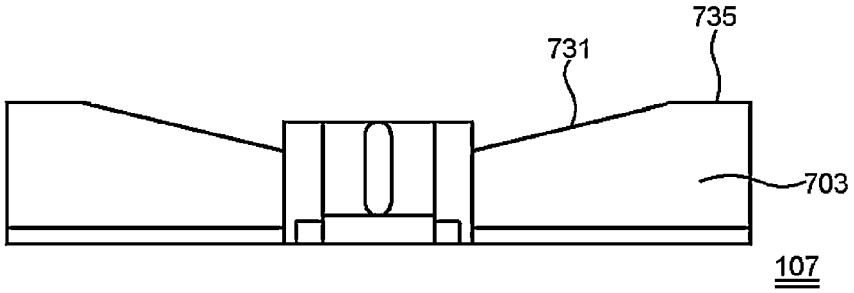
FIG. 20 is a side view showing the impeller of FIG. 19.

FIG. 19 is a plan view showing an impeller of FIG. 5, and FIG. 20 is a side view showing the impeller of FIG. 19.

The impeller 107 is coupled to the rotary shaft 211 at the center thereof in such a manner as to be adjacent to the rotary blade part 111 and located inside the discharge part 135. As the rotary shaft 211 is rotated, the impeller 107 increases the flow of air moving along the chambers formed between the rotary blade part 111 and the fixed blade part 113, so that the grinded object grinded to desired particle sizes in each stage grinding portion can be rapidly moved to next stage grinding portion and at the same time the heat generated during the grinding can be effectively dissipated.

That is, the flow of air is increased in the direction from the first chamber 810 toward the fourth chamber 840, thereby solving the conventional problem that the grinded object grinded to desired particle sizes in each chamber is not moved to next chamber and thus melted.

As shown in FIGS. 19 and 20, the impeller 107 has a disc 701 formed of a round plate, a plurality of blades 703 and 705 formed of plates having given lengths in such a manner as to be mounted vertically on one surface of the disc 701, and a rotary shaft through-hole 707 formed on the center of the disc 701 in such a manner as to be coupled to the rotary shaft 211.

The blades 703 and 705 are formed of rectangular plates having given lengths, and in this case, the blades 703 are long, while the blades 705 are being shorter than the long blades 703.

Further, one end portions of the long blades 703 and the short blades 705 are connected to the outer periphery of the disc 701 and the other end portions thereof are located toward the rotary shaft through-hole 707 formed on the center of the disc 701. At this time, the lengths of the long blades 703 are shorter than the radius of the disc 701, so that the other end portions of the long blades 703 and the short blades 705 are separated from the rotary shaft through-hole 707.

Further, the upper portion surface of each of the blades 703 and 705 facing the contacted surface with the disc 701 is composed of an inclined surface 731 and a horizontal surface 753. At this time, the inclined surface 731 is raised as it goes from the end portion near the center of the disc 701 toward the outside, and the horizontal surface 735 is connected to the inclined surface 731 in such a manner as to have the other end portion located toward the outer periphery of the disc 701.

At this time, the blades 703 and 705 have the inclined surfaces 731 on the upper portion surfaces thereof, and accordingly, when the impeller 107 is located inside the discharge part 135, the formation of the inclined surfaces 731 decreases the separation distance between the inner surface of a discharge body 351 of the discharge part 135 and the upper portion surfaces of the blades 703 and 705, thereby minimizing the pressure loss caused by the separation distance, that is, increasing the discharge pressure to remarkably increase the flow of air.

Figure 21A:
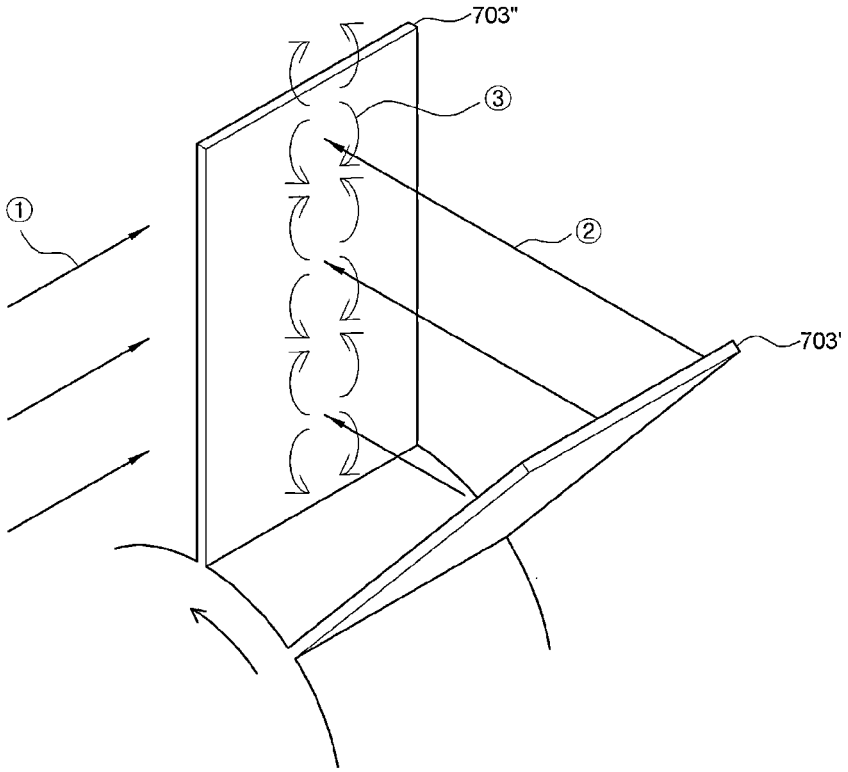
FIG. 21*a* is an exemplary view showing the plane blades of the impeller.
Figure 21B:
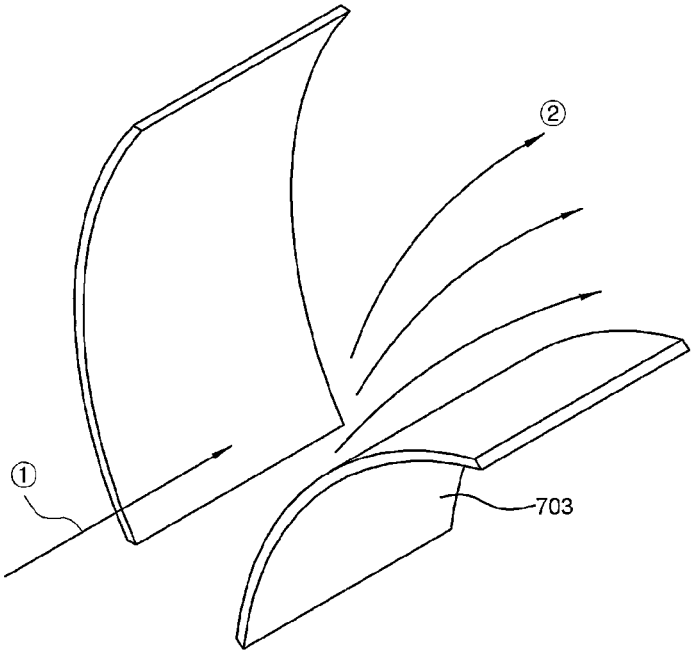
FIG. 21*b* is an exemplary view showing the curved blades of the impeller.

FIG. 21*a* is an exemplary view showing the plane blades of the impeller, and FIG. 21*b* is an exemplary view showing the curved blades of the impeller.

Referring to FIG. 21*a* showing the plane blades 703 and 705 of the impeller 107, as blades 703" and 703'" are rotated, the air introduced from the jet mill 1 combining the high speed grinding apparatus is reflected through collision against one side of one side blade 703" and moved and reflected to the facing surface of the neighboring blade 703'", thereby generating turbulent flows.

However, the impeller 107 adopted in the present invention have the curved blades 703 and 705 as shown in FIG. 21*b*, and accordingly, if the air introduced collides against one surface of the blade 703, the colliding air is not moved to the neighboring blade 705, but moved to the outside along the curved surface of the blade 703.

Accordingly, the grinded object having the particle sizes in the range between 100 μm and 1000 μm introduced from the jet mill 1 combining the high speed grinding apparatus is moved to the outside by means of the impeller 107 and thus moved to the discharge pipe 235.

Figure 22:
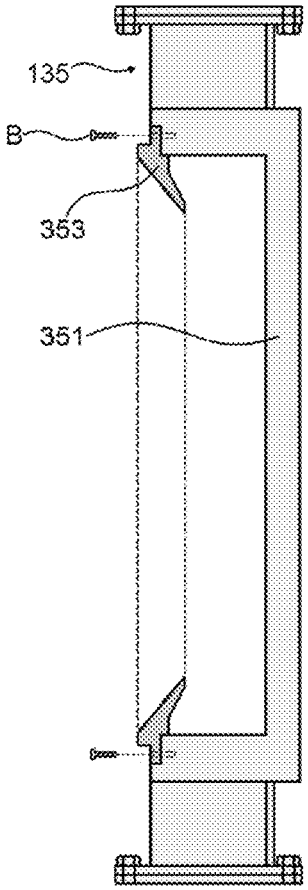
FIG. 22 is a side sectional view showing a discharge part of the housing unit of FIG. 5.

FIG. 22 is a side sectional view showing the discharge part of the housing unit of FIG. 5.

The discharge part 135 includes: the body 351 having one side surface open to rotatably insert the impeller 107 thereinto in such a manner as to be coupled to the other side of the support rod 131; and a flow adjustor 353 formed of a disc having a hollow portion in such a manner as to be coupled to the opening of the body 351 by means of bolts B.

The body 351 of the discharge part 135 is coupled to the other side of the support rod 131 in such a manner as to allow the opening to be located toward the rotary blade part 111.

Since the impeller 107 is mounted inside the body 351, further, the body 351 absorbs air in the direction of the grinding unit 101 through the rotation of the impeller 107 to allow the grinded object to be rapidly moved to the impeller 107.

Figure 23:
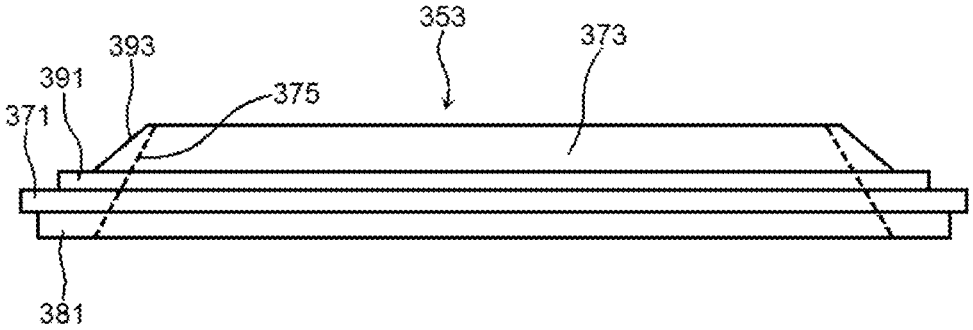
FIG. 23 is a side sectional view showing a flow adjustor of FIG. 21.

FIG. 23 is a side sectional view showing the flow adjustor of FIG. 21.

The flow adjustor 353 is coupled to the opening of the body 351 by means of the bolts B.

Further, the flow adjustor 353 includes a disc 371, a front surface protrusion 381 protruded outwardly in the shape of a cylinder from one side surface of the disc 371, and a rear surface protrusion 391 protruded outwardly from the other side surface of the disc 371, and a hollow portion 373 is formed unitarily on the centers of the disc 371, the front surface protrusion 381 and the rear surface protrusion 391.

At this time, the flow adjustor 353 is mounted on the opening of the body 351 in such a manner as to allow the front surface protrusion 381 to be formed toward the grinding unit 101 and allow the rear surface protrusion 391 to be formed toward the interior of the body 351.

Further, an inner peripheral surface 375, which forms the hollow portion 373 of the disc 371, the front surface protrusion 381 and the rear surface protrusion 391, is formed of an inclined surface formed inclinedly toward the center of a circle as it goes from one side surface where the front surface protrusion 381 is formed toward the other side surface where the rear surface protrusion 391 is formed.

At this time, an outer peripheral surface 393 of the rear surface protrusion 391 is desirably formed of an inclined surface formed inclinedly toward the center of a circle as it goes toward the outside.

Accordingly, the rear surface protrusion 391 is protruded from one side surface of the disc 371 located toward the inside of the body 351, and the inner peripheral surface forming the hollow portion 373 is formed of the inclined surface, thereby increasing the flow of air. The reason and method for increasing the flow of air will be in detail explained with reference to FIGS. 24*a* and 24*b*.

Figure 24A:
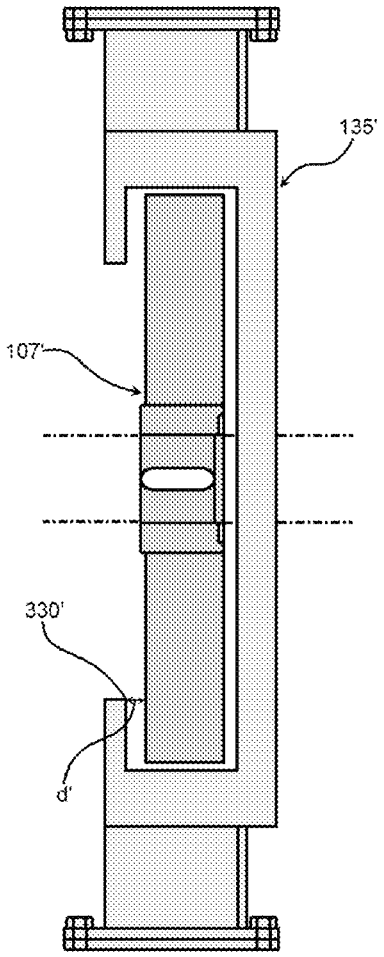
FIG. 24*a* is a side sectional view showing a housing unit on which the impeller is disposed in the conventional practice.
Figure 24B:
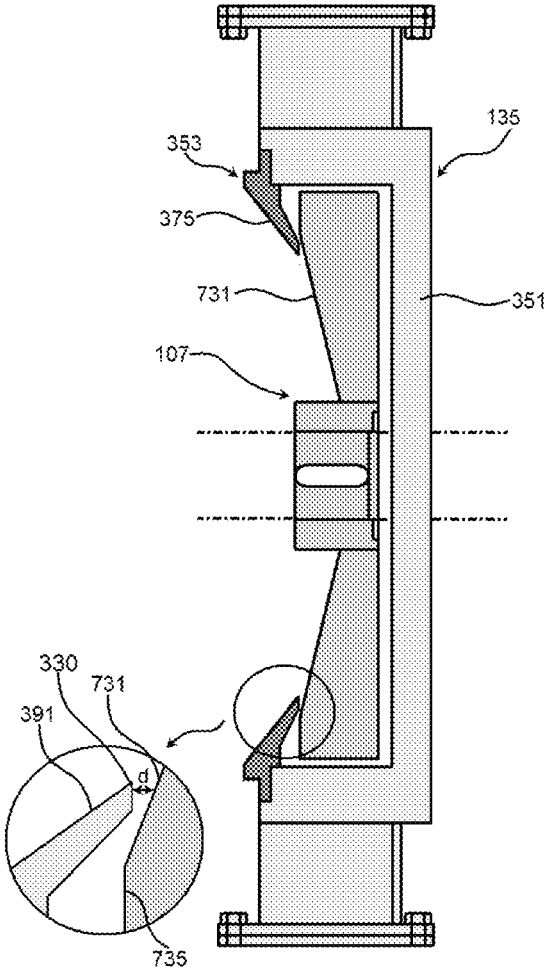
FIG. 24*b* is a side sectional view showing a housing unit on which the impeller is disposed according to the present invention.

FIG. 24*a* is a side sectional view showing a housing unit on which the impeller is disposed in the conventional practice, and FIG. 24*b* is a side sectional view showing a housing unit on which the impeller is disposed according to the present invention.

In the high speed grinding apparatus 100 according to the present invention, the jet mill 1 combining the high speed grinding apparatus and the grinding unit 101 are disposed separated from each other by a given distance, thereby forming a given space (hereinafter, referred to as staying space) therebetween. At this time, the volume of the staying space is remarkably more increased when compared with the volume of the fourth chamber 840, and thus, the air discharged from the fourth chamber 840 has pressure loss within the staying space.

That is, the pressure loss of the air is generated in the staying space between the fourth chamber 840 and the jet mill 1 combining the high speed grinding apparatus, so that the air discharged from the fourth chamber 840 is circulated in the staying space, while being not passed through the staying space.

Accordingly, the staying space undesirably reduces the flow of air of the high speed grinding apparatus 1, which causes the circulation of the air passing through the chambers to be decreased and also makes the heat dissipation efficiency deteriorated. Furthermore, the grinded object grinded to desired particle sizes in each chamber is not moved well to next chamber and thus melted. Especially, aluminum has a high degree of softness and is weak in heat, so that the reduction of the heat dissipation efficiency and the staying problem of the grinded object cause the waste aluminum to be melted, which makes the apparatus undesirably malfunctioned.

So as to increase the flow of air moving each chamber, to enhance the heat dissipation efficiency, and to prevent the grinded waste aluminum object from being melted, accordingly, the structures and shapes of the impeller 107 and the body 351 of the discharge part 135 into which the impeller 107 is mounted are proposed through the present invention.

As shown in FIG. 24*a*, an impeller 107' is mounted in the opening of a discharge part 135' in the conventional practice, and in this case, the impeller 107' is separated from the inner surface of the discharge part 135' so as to prevent the contact with the discharge part 135' upon the rotation thereof.

Accordingly, the impeller 107' is separated by a given distance d' from an inner side end portion 330' on one side surface forming the open portion of the discharge part 135'. At this time, the given distance d' is called impeller distance.

The impeller 107' is rotated inside the discharge part 135' through the rotation of the rotary shaft 211, thereby increasing the flow of air, but when absorbing the air, the pressure loss of the air introduced from the staying space is caused through the impeller distance d', thereby making the function of increasing the flow of air performed by the impeller 107' undesirably decreased. That is, when the impeller 107' is mounted inside the discharge part 135', the discharge pressure of the impeller 107' is decreased in proportion to the impeller distance d', and accordingly, as the impeller distance d' is increased, the flow of air passing through the grinding unit 101 becomes decreased.

So as to overcome the above-mentioned problems, as shown in FIG. 24*b*, the blades of the impeller 107 have the inclined surfaces 731, and the flow adjustor 353 is bolt-coupled to the opening of the body 351 of the discharge part 135, while having the front surface protrusion 381 and the rear surface protrusion 391 having the inner peripheral surface 375 formed of the inclined surface, so that the introduced air is collected to the impeller 107 along the inner peripheral surface 375.

Since the rear surface protrusion 391 of the flow adjustor 353 is protrudedly formed toward the inner side of the body 351 of the discharge part 135, further, the impeller distance d between the inner side end portion 330 and the impeller 107 is remarkably more decreased when compared with that of FIG. 24*a*, thereby decreasing the pressure loss of the air. At this time, the blades of the impeller 107 have the inclined surfaces 731, and accordingly, the rear surface protrusion 391 is more protruded toward the inner side of the body 351 of the discharge part 135.

Further, as shown in FIG. 22, the flow adjustor 353 is detachably coupled to the body 351 of the discharge part 135 by means of the bolts, and accordingly, flow adjustors having different inclination angles of inner peripheral surfaces may be previously manufactured, so that if the discharge pressure is lower than previously set pressure, the flow adjustor is replaced with that having a high inclination angle to increase the discharge pressure, and contrarily, if higher than that, it is replaced with that having a low inclination angle to decrease the discharge pressure. That is, the flow of air can be controlled just through the simple replacing of the flow adjustor 353, without having any separate discharge pressure controlling means.

Figure 25:
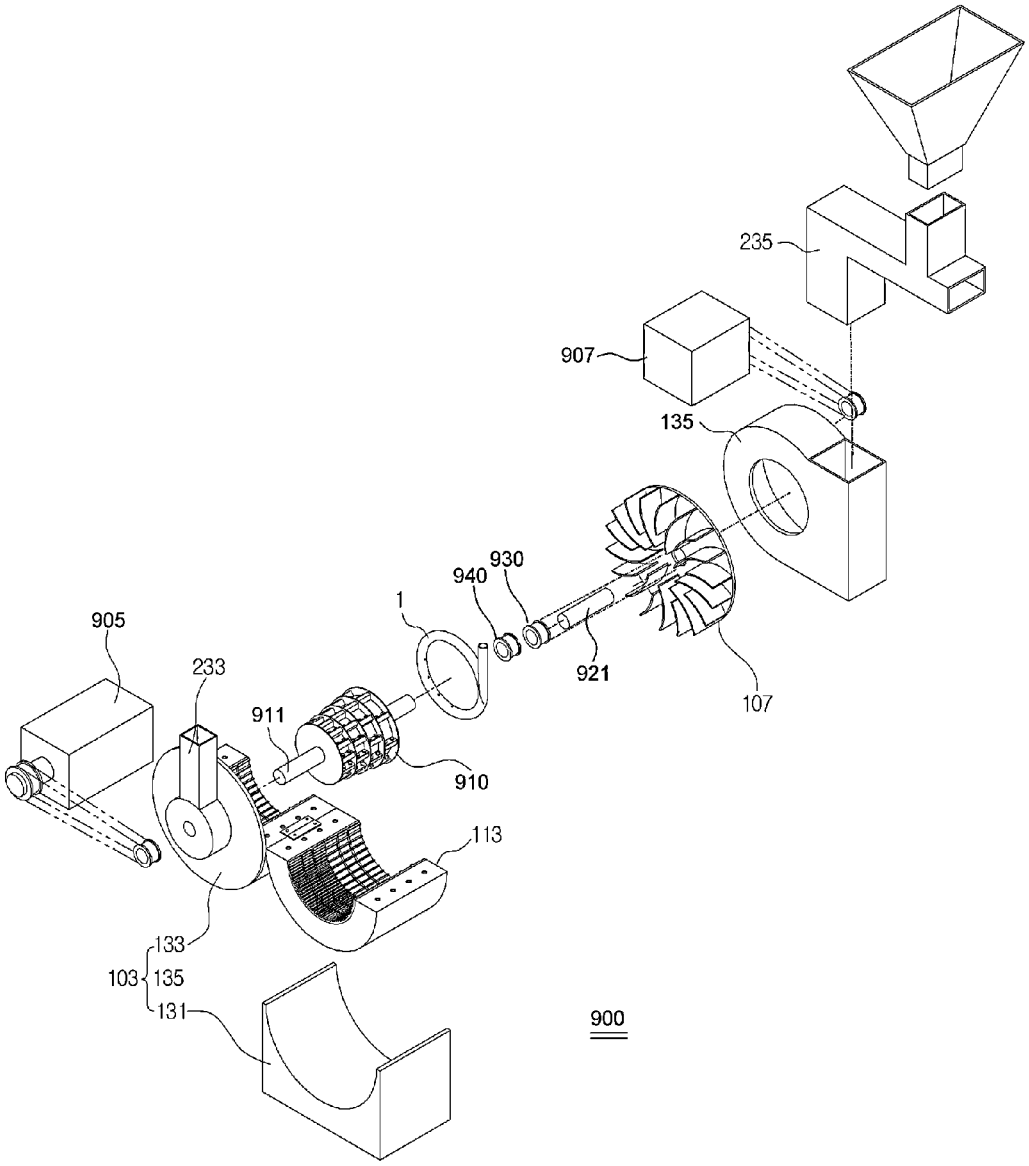
FIG. 25 is a perspective view showing a high speed grinding apparatus according to a second embodiment of the present invention.

FIG. 25 is an exploded perspective view showing a high speed grinding apparatus according to a second embodiment of the present invention.

A high speed grinding apparatus 900 according to a second embodiment of the present invention has the same shape and structure as that of FIG. 5, while further including a first rotor 905 adapted to rotate a first rotary shaft 911 of a rotary blade part 910 and a second rotor 907 adapted to rotate a second rotary shaft 921 coupled to an impeller 107, wherein the rotary blade part 910 is coupled to the first rotary shaft 911 and rotated by the first rotor 905, and the impeller 107 is coupled to the second rotary shaft 921 and rotated by the second rotor 907.

That is, the first rotary shaft 911 is rotated by the first rotor 905 in such a manner as to be coupled rotatably to the side wall of the introduction part 133 on one end portion thereof, and the second rotary shaft 921 is rotated by the second rotor 907 in such a manner as to be coupled rotatably to the side wall of the discharge part 135 on one end portion thereof and coupled rotatably to the impeller 107 on the other end portion thereof by means of a second bearing 930. At this time, the other end portion of the first rotary shaft 911 is coupled to a first bearing 940 coupled to the second bearing 930, so that the first rotary shaft 911 and the second rotary shaft 930 are separated from each other and rotated through the first rotor 905 and the second rotor 907.

Therefore, the high speed grinding apparatus 900 according to the second embodiment of the present invention is configured wherein the impeller 107 is rotated independently of the rotary blade part 910, thereby controlling the rotation speed of the impeller 107 and adjusting the sizes of the grinded object being discharged. That is, if the size of the grinded object being discharged is larger than a desired size, the rotation speed of the impeller 107 is raised to increase the discharge pressure of air, and contrarily, if smaller than the desired size, the rotation speed of the impeller 107 is lowered to decrease the discharge pressure of air, so that the discharge pressure of air can be easily controlled, without any exchange of the internal parts of the apparatus.

As set forth in the foregoing, according to the present invention, waste aluminum can be grinded into aluminum granules having the particle sizes in the range between 100 μm and 1000 μm.

According to the present invention, moreover, the injection holes are spaced apart from each other along the inner side peripheral surface of the body of the jet mill to induce the particle collision of the grinded object, without having any separate injection device such as air nozzles, thereby saving manufacturing cost and reducing the time and cost required for exchanging the parts within the apparatus with new ones.

According to the present invention, additionally, the number of injection holes is 10 to 14 and the approach angles toward air of the injection holes are limited in the range between 30° and 60°, thereby optimizing the particle collision of the grinded object.

According to the present invention, furthermore, the rotary blades and the fixed blades are located in multiple stages to distribute the heat excessively generated during the particle collision and to respond to the properties of aluminum having a high degree of softness, and further, the grinded object passed through the rotary blades and the fixed blades is grinded to the particle sizes in the range between 100 μm and 1000 μm through the jet mill, thereby effectively distributing the heat generated during the grinding of aluminum to easily perform the grinding process, without stopping, and at the same time manufacturing the granules having fine particle sizes.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A high speed grinding apparatus comprising:

a rotary shaft rotated by a rotor;

a support rod having a curved recess open upwardly;

a grinding unit having a rotary blade part having the center formed in a shape of a cylinder coupled to the rotary shaft and a plurality of rotary blades formed on the outer peripheral surface thereof, the rotary blade part being increased in diameter as it goes from one side thereof toward the other side thereof, and a fixed blade part mounted on the curved recess of the support rod in such a manner as to be located on the concentric circle of the first rotary shaft and having a plurality of fixed blades formed on the inner peripheral surface thereof in such a manner as to be spaced apart from each other with a given distance separated from the turning radius of the rotary blades;

an introduction part mounted on one side of the rotary blade part and having an introduction hole formed to introduce an object thereinto;

a discharge part mounted on the other side of the grinding unit and having a discharge hole formed to discharge the grinded object therefrom and an opening formed on one surface toward the grinding unit;

a jet mill mounted adjacent to the grinding unit in such a manner as to pass the rotary shaft through the center thereof and adapted to inject pressurizing air into the grinded object if the grinded object is introduced from the grinding unit, thereby performing grinding through the particle collision of the grinded object; and an impeller mounted on the opening of the discharge part and having a disc rotatably fitted to the outer peripheral surface of the rotary shaft and a plurality of blades mounted vertically on the disc, wherein the grinded object is introduced into the space between the rotary blade part and the fixed blade part, collides against each other through the rotation of the rotary blades, and is introduced into the jet mill, and next, the particles of the grinded object collide against each other through the swirling movements of the pressurizing air injected from the jet mill and grinded to fine particle sizes, and wherein the impeller is rotated through the rotation of the rotary shaft to increase the discharge pressure of air and at the same time collides the grinded object introduced from the jet mill against the blades to discharge the grinded object to the discharge part.

2. The high speed grinding apparatus according to claim 1, wherein the rotary blade part comprises:

rotary bodies taking the shapes of cylinders having different diameters and having the centers coupled to the first rotary shaft;

disc-shaped locking plates having the centers coupled to the first rotary shaft in such a manner as to be located between the neighboring rotary bodies; and the plurality of rotary blades mounted on the outer peripheral surfaces of the rotary bodies, the rotary bodies being coupled to the first rotary shaft in such a manner as to be increased in diameter as they go from one side near the introduction part toward the other side near the discharge part.

3. The high speed grinding apparatus according to claim 2, wherein the fixed blades are formed on the inner peripheral surface of the fixed blade part in parallel to the first rotary shaft, and the fixed blade part has vortex flow grooves formed between the fixed blades adjacent to each other on the arch thereof to generate vortex flows therefrom.

4. The high speed grinding apparatus according to claim 3, wherein if the fixed blades and the vortex flow grooves formed on the concentric circle of the fixed blade part are contained in one fixed blade arrangement, the fixed blade part has a plurality of fixed blade arrangements, and the number of fixed blade and vortex flow grooves formed on one fixed blade arrangement is equal to or less than that formed on other fixed blade arrangements, along the moving passage of the grinded object.

5. The high speed grinding apparatus according to claim 4, wherein the fixed blade arrangements face the outer peripheral surfaces of the rotary bodies.

6. The high speed grinding apparatus according to claim 5, wherein the number of rotary bodies is 4, and along the moving passage of the grinded object, the distance of the first rotary body from the fixed blades is 6 mm, the distance of the second rotary body from the fixed blades is 5 mm, the distance of the third rotary body from the fixed blades is 3 mm, and the distance of the fourth rotary body from the fixed blades is 2 mm.

7. The high speed grinding apparatus according to claim 5, wherein the fixed blade arrangements are composed of a first fixed blade arrangement, a second fixed blade arrangement, a third fixed blade arrangement and a fourth fixed blade arrangement, along the moving passage of the grinded object, and the vortex flow grooves formed on the first and second fixed blade arrangements have the shape of '⋁', while the vortex flow grooves formed on the third and fourth fixed blade arrangements having the shape of 'U'.

8. The high speed grinding apparatus according to claim 5, further comprising cooling water supply means adapted to supply cooling water, wherein the fixed blade part has at least one or more cooling passages formed at the inside thereof, through which the cooling water introduced from the cooling water supply means is moved.

9. The high speed grinding apparatus according to claim 8, wherein the cooling passages are spaced apart from each other on the concentric circle of the first rotary shaft along the longitudinal direction of the fixed blade part in such a manner as to correspond to the respective fixed blade arrangements.

10. The high speed grinding apparatus according to claim 9, wherein the fixed blade part comprises: a first case and a second case cut in the longitudinal direction thereof in such a manner as to be disposed to face each other; and a hinge-coupling means adapted to be hinge-coupled to the first case on one end portion thereof and to be hinge-coupled to the second case on the other end portion thereof, the first case and the second case being open and closed by means of the hinge-coupling means.

11. The high speed grinding apparatus according to claim 1, wherein the blades of the impeller are any one of long and short blades, and one end portions of the blades are located toward the center of the disc, while the other end portions thereof are being connected to the outer periphery of the disc.

12. The high speed grinding apparatus according to claim 11, wherein the blades are curved.

13. The high speed grinding apparatus according to claim 11, wherein the discharge part further comprises a flow adjustor detachably coupled to the opening thereof, and the flow adjustor comprises: a disc; a front surface protrusion protruded outwardly in the shape of a cylinder from one side surface of the disc; a rear surface protrusion protruded outwardly in the shape of a cylinder from the other side surface of the disc, and a hollow portion formed unitarily on the centers of the disc, the front surface protrusion and the rear surface protrusion, through which the first rotary shaft is passed, the inner peripheral surface forming the hollow portion being formed of an inclined surface formed inclinedly toward the center of a circle as it goes from one side surface where the front surface protrusion is formed toward the other side surface where the rear surface protrusion is formed, so that the flow of air passing through the distance from the fixed blades is adjusted in accordance with the inclination angle of the inclined surface.

14. The high speed grinding apparatus according to claim 1, wherein each rotary blade has at least one or more inclined surfaces formed on one surface thereof toward the rotating direction thereof.

15. The high speed grinding apparatus according to claim 1, wherein the jet mill comprises injection holes formed to have approach angles formed from one end portion connected to the moving passage of the grinded object toward the other end portion formed on the inner side thereof, the approach angles being inclined as they go from the other end portion toward the center thereof.

16. The high speed grinding apparatus according to claim 15, wherein if the injection holes having the same approach angles as each other are defined as one group, the injection holes are contained in any one of the group having the approach angles of 30° and the group having the approach angles of 60°.

17. The high speed grinding apparatus according to claim 16, wherein the number of injection holes contained in one group is the same as the number of injection holes contained in the other group.

18. A high speed grinding apparatus comprising:

a first rotary shaft rotated by a first rotor;

a second rotary shaft rotated by a second rotor;

a support rod having a curved recess open upwardly;

a grinding unit having a rotary blade part having the center formed in a shape of a cylinder coupled to the first rotary shaft and having a plurality of rotary blades formed on the outer peripheral surface thereof, the rotary blade part being increased in diameter as it goes from one side thereof toward the other side thereof, and a fixed blade part mounted on the curved recess of the support rod in such a manner as to be located on the concentric circle of the first rotary shaft and having a plurality of fixed blades formed on the inner peripheral surface thereof in such a manner as to be spaced apart from each other with a given distance separated from the turning radius of the rotary blades;

an introduction part mounted on one side of the rotary blade part and having an introduction hole formed to introduce an object thereinto and a side wall to which the first rotary shaft is rotatably coupled;

a discharge part mounted on the other side of the grinding unit and having a discharge hole formed to discharge the grinded object therefrom, an opening formed on one surface toward the grinding unit and a side wall to which the second rotary shaft is rotatably coupled;

a jet mill mounted adjacent to the grinding unit and adapted to inject pressurizing air into the grinded object if the grinded object is introduced from the grinding unit, thereby performing grinding through the particle collision of the grinded object; and an impeller mounted on the opening of the discharge part and having a disc rotatably fitted to the outer peripheral surface of the second rotary shaft and a plurality of plate-like blades mounted vertically on the disc, wherein the grinded object is introduced into the space between the rotary blade part and the fixed blade part, collides against each other through the rotation of the rotary blades, and is introduced into the jet mill, and next, the particles of the grinded object collide against each other through the swirling movements of the pressurizing air injected from the jet mill and grinded to fine particle sizes, and wherein the impeller is rotated through the rotation of the second rotary shaft to increase the discharge pressure of air and at the same time collides the grinded object introduced from the jet mill against the blades to discharge the grinded object to the discharge part.

* * * * *